US012228322B2

(12) United States Patent
Saeki et al.

(10) Patent No.: US 12,228,322 B2
(45) Date of Patent: Feb. 18, 2025

(54) CASCADE UNIT AND REFRIGERATION SYSTEM

(71) Applicant: DAIKIN INDUSTRIES, LTD., Osaka (JP)

(72) Inventors: Kumiko Saeki, Osaka (JP); Yuta Iyoshi, Osaka (JP); Yoshiki Yamanoi, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 0 days.

(21) Appl. No.: 18/621,484

(22) Filed: Mar. 29, 2024

(65) Prior Publication Data

US 2024/0263845 A1 Aug. 8, 2024

Related U.S. Application Data

(63) Continuation of application No. PCT/JP2022/035578, filed on Sep. 26, 2022.

(30) Foreign Application Priority Data

Sep. 30, 2021 (JP) ..... 2021-161796

(51) Int. Cl.
*F25B 7/00* (2006.01)
*F25B 41/40* (2021.01)

(52) U.S. Cl.
CPC ..... *F25B 7/00* (2013.01); *F25B 41/40* (2021.01)

(58) Field of Classification Search
CPC ..... F25B 7/00; F25B 41/40
See application file for complete search history.

(56) References Cited

U.S. PATENT DOCUMENTS

2021/0333021 A1 10/2021 Matsuoka et al.
2022/0316767 A1* 10/2022 Yamada ..... F25B 13/00

FOREIGN PATENT DOCUMENTS

CN 202927983 U 5/2013
CN 110770516 A 2/2020
(Continued)

OTHER PUBLICATIONS

English translation of the International Preliminary Report on Patentability and Written Opinion of the International Searching Authority for International Application No. PCT/JP2022/035578, dated Apr. 2, 2024.

(Continued)

*Primary Examiner* — Miguel A Diaz
(74) *Attorney, Agent, or Firm* — Birch, Stewart, Kolasch & Birch, LLP

(57) ABSTRACT

A cascade unit is a cascade unit of a refrigeration system including a first circuit, a second circuit, and a cascade heat exchanger. The first circuit includes a first connecting portion that connects a first pipe and a second pipe extending from the cascade heat exchanger, of the first pipe and the second pipe connecting a first heat exchanger and the cascade heat exchanger), to the first pipe and the second pipe extending from the first heat exchanger inside or outside a cascade casing. The second circuit includes a second connecting portion that connects a liquid pipe and gas pipes extending from the cascade heat exchanger, among the liquid pipe and the gas pipes connecting second heat exchangers and the cascade heat exchanger, to the liquid pipe and the gas pipes extending from the second heat exchangers inside or outside the cascade casing.

20 Claims, 12 Drawing Sheets

(56) References Cited

FOREIGN PATENT DOCUMENTS

| | | | |
|---|---|---|---|
| JP | 4-165241 | A | 6/1992 |
| JP | 6-307742 | A | 11/1994 |
| JP | H9-229431 | A | 9/1997 |
| JP | 2009-236339 | A | 10/2009 |
| JP | 2012-193866 | A | 10/2012 |
| JP | 2013-113546 | A | 6/2013 |
| JP | 2020-190381 | A | 11/2020 |

OTHER PUBLICATIONS

International Search Report, issued in PCT/JP2022/035578, PCT/ISA/210, dated Dec. 6, 2022.
Extended European Search Report for European Application No. 22876091.4, dated Dec. 11, 2024.

* cited by examiner

CASCADE UNIT AND REFRIGERATION SYSTEM

CROSS REFERENCE TO RELATED APPLICATIONS

This application is a Continuation of PCT International Application No. PCT/JP2022/035578, filed on Sep. 26, 2022, which claims priority under 35 U.S.C. § 119(a) to Patent Application No. JP 2021-161796, filed in Japan on Sep. 30, 2021, all of which are hereby expressly incorporated by reference into the present application.

TECHNICAL FIELD

The present disclosure relates to a cascade unit and a refrigeration system.

BACKGROUND ART

Patent Literature 1 (JP 2012-193866 A) discloses a refrigeration apparatus in which a high-temperature side refrigerant circulation circuit and a low-temperature side refrigerant circulation circuit are cascade-connected via a cascade capacitor. The refrigeration apparatus disclosed in Patent Literature 1 includes an outdoor unit including a high-temperature side housing and a low-temperature side housing that are adjacent to each other. The high-temperature side service valve is disposed near a side wall of the high-temperature side housing, the side wall facing a side wall adjacent to the low-temperature side housing. The low-temperature side service valve is disposed near a side wall of the low-temperature side housing, the side wall facing a side wall adjacent to the high-temperature side housing.

SUMMARY

A cascade unit according to a first aspect is a cascade unit of a refrigeration system including a first circuit, a second circuit, and a cascade heat exchanger. A heat medium that conveys heat flows through the first circuit. The first circuit includes a first heat exchanger. The first heat exchanger causes a heat source and the heat medium to exchange heat with each other. The second circuit includes a second compressor and a second heat exchanger. The second compressor compresses a second refrigerant. The second heat exchanger exchanges heat between the second refrigerant and indoor air. The second refrigerant circulates in the second circuit. The cascade heat exchanger exchanges heat between the heat medium in the first circuit and the second refrigerant in the second circuit. The cascade unit includes the cascade heat exchanger, the second compressor, and a casing. The casing accommodates the cascade heat exchanger and the second compressor. The first circuit includes a first connecting portion. The first connecting portion connects a first pipe and a second pipe extending from the cascade heat exchanger, of the first pipe and the second pipe connecting the first heat exchanger and the cascade heat exchanger, to the first pipe and the second pipe extending from the first heat exchanger inside or outside the casing. The second circuit includes a second connecting portion. The second connecting portion connects a liquid pipe and a gas pipe extending from the cascade heat exchanger, of the liquid pipe and the gas pipe connecting the second heat exchanger and the cascade heat exchanger, to the liquid pipe and the gas pipe extending from the second heat exchanger inside or outside the casing. The first connecting portion and the second connecting portion are disposed close to each other.

DESCRIPTION OF EMBODIMENTS (1) Configuration of Refrigeration System

Figure 1:
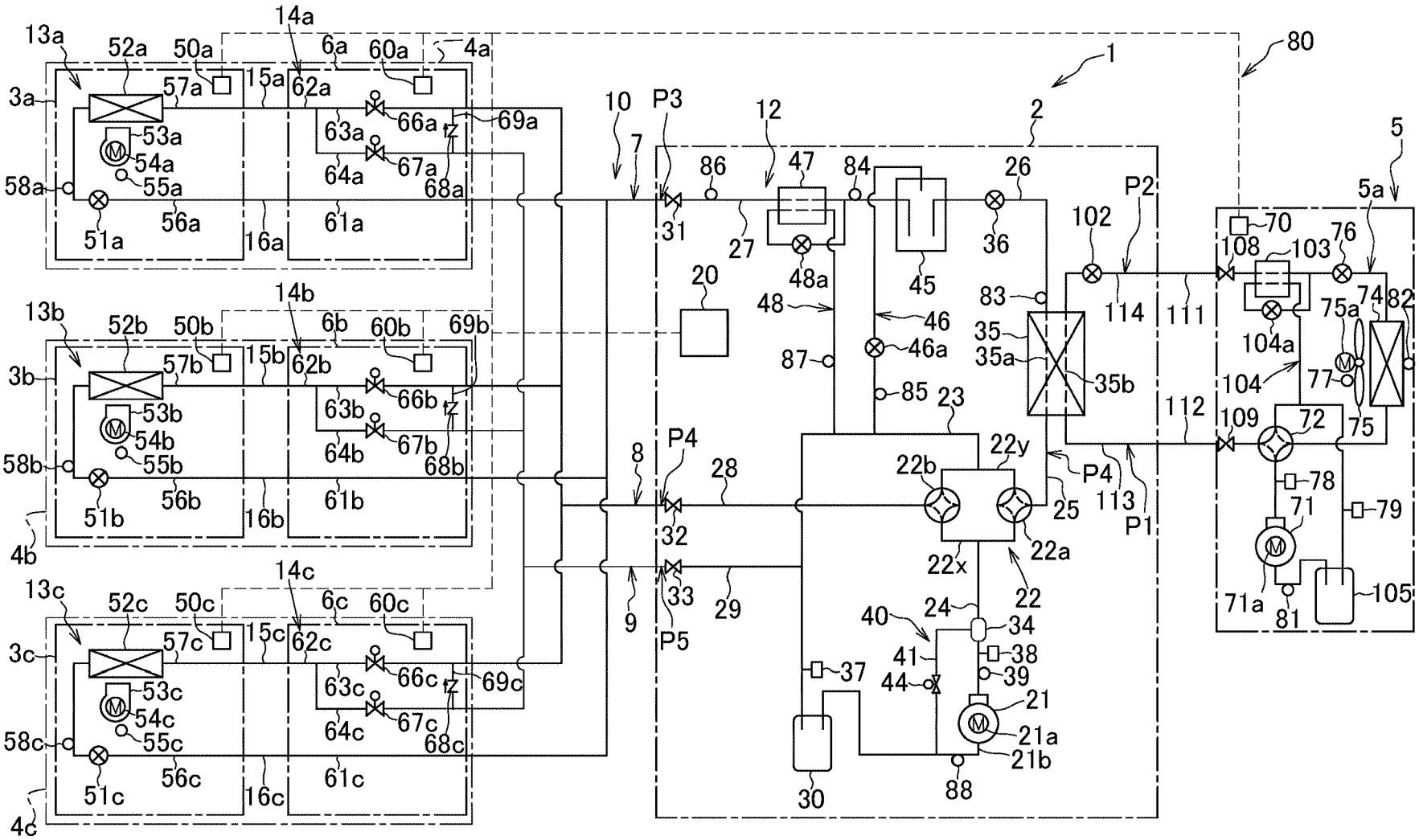
FIG. 1 is a schematic configuration diagram of a refrigeration system.
Figure 2:
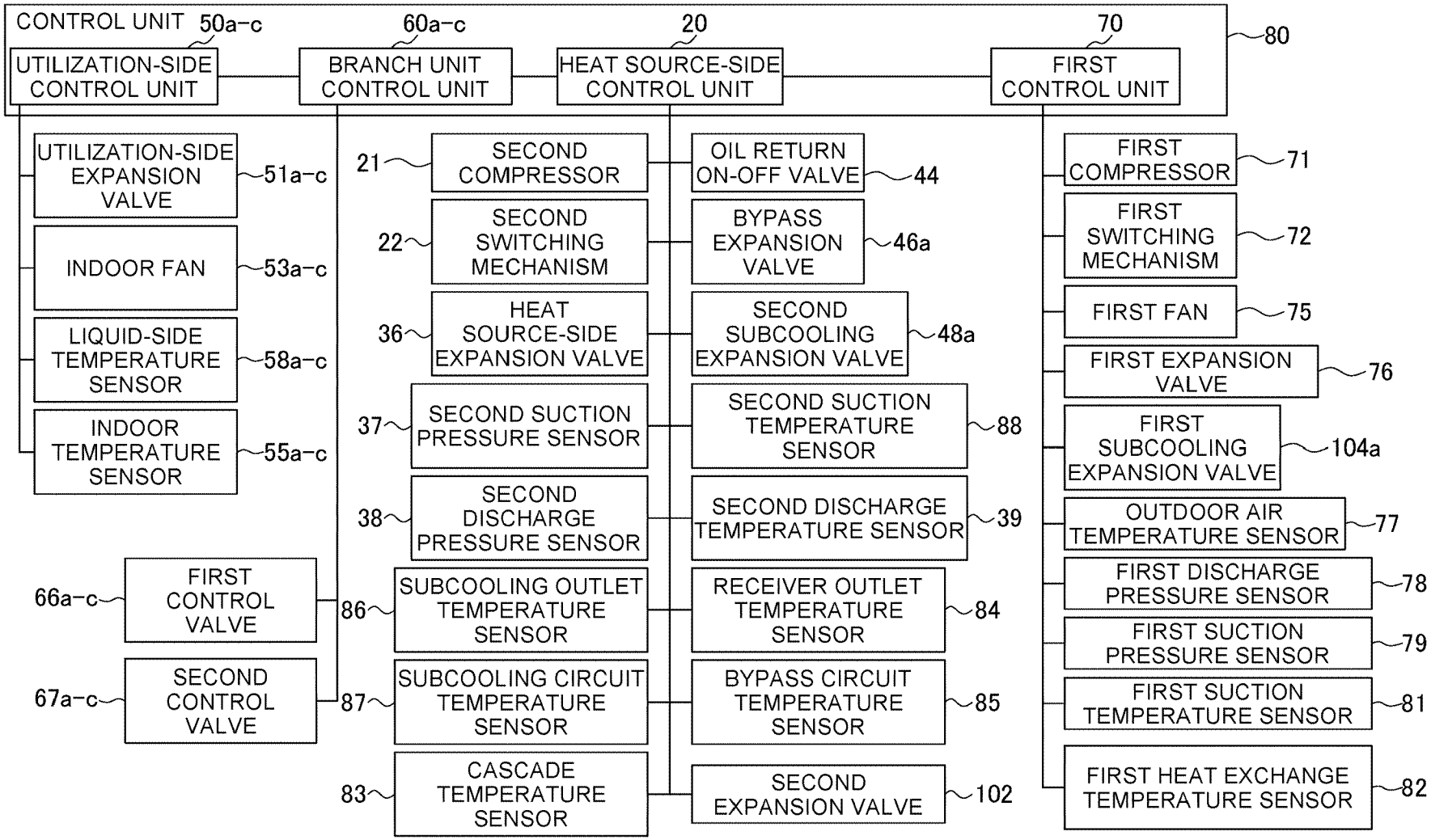
FIG. 2 is a schematic functional block configuration diagram of the refrigeration system.

A refrigeration system 1 shown in FIGS. 1 and 2 is configured to execute vapor compression refrigeration cycle operation to be used for cooling or heating an indoor space of an office building or the like.

The refrigeration system 1 includes a first circuit (primary-side circuit) 5*a*, a second circuit (secondary-side circuit) 10, and a cascade heat exchanger 35. The first circuit 5*a* includes a first heat exchanger 74. The second circuit 10 includes a second compressor 21 and second heat exchangers 52*a*, 52*b*, and 52*c*. The refrigeration system 1 according to the present embodiment includes a binary refrigerant circuit including the first circuit 5*a* of vapor compression and the second circuit 10 of vapor compression, and performs a binary refrigeration cycle.

A heat medium that conveys heat circulates in the first circuit 5*a*. Here, the heating medium includes a first refrigerant. The first refrigerant includes, for example, at least one of an HFC refrigerant or an HFO refrigerant. A second refrigerant circulates in the second circuit 10. The second refrigerant includes, for example, carbon dioxide.

The first circuit 5*a* and the second circuit 10 are thermally connected via the cascade heat exchanger 35.

The first circuit 5*a* includes a first pipe P1 and a second pipe P2 that connect the first heat exchanger 74 and the cascade heat exchanger 35. The first heat exchanger 74 exchanges heat between the heat medium circulating in the first circuit 5*a* and a heat source. The heat source functions as a heating source or a cooling source of the heat medium circulating in the first circuit 5*a*. The heat source here is outdoor air that exchanges heat with the first refrigerant as a heat medium.

The second circuit 10 includes a liquid pipe P3 and gas pipes P4 and P5 that connect the second heat exchangers 52*a*, 52*b*, and 52*c* and the cascade heat exchanger 35. In the present embodiment, the number of liquid pipes P3 is one, and the number of gas pipes P4 and P5 is two.

The refrigeration system 1 includes a first unit 5, a cascade unit 2, and second units 4*a*, 4*b*, and 4*c*. The first unit 5 includes the first heat exchanger 74. The second units 4*a*, 4*b*, and 4*c* include the second heat exchangers 52*a*, 52*b*, and 52*c*. In the present embodiment, the second units 4*a*, 4*b*, and 4*c* include branch units 6*a*, 6*b*, and 6*c* and utilization units 3*a*, 3*b*, and 3*c*.

The refrigeration system 1 includes the first unit 5, the cascade unit 2, and the second units 4*a*, 4*b*, and 4*c* which are connected to each other via pipes. The first unit 5 and the cascade unit 2 are connected via a first connection pipe 112 and a second connection pipe 111. The cascade unit 2 and the plurality of branch units 6*a*, 6*b*, and 6*c* are connected to each other by three connection pipes, namely, a third connection pipe 7, a fourth connection pipe 8, and a fifth connection pipe 9. The plurality of branch units 6*a*, 6*b*, and 6*c* and the plurality of utilization units 3*a*, 3*b*, and 3*c* are connected via first connecting tubes 15*a*, 15*b*, and 15*c* and second connecting tubes 16*a*, 16*b*, and 16*c*.

One first unit 5 is provided in the present embodiment. A single cascade unit 2 is provided in the present embodiment. Three second units 4*a*, 4*b*, and 4*c* are provided in the present embodiment. Specifically, the plurality of utilization units 3*a*, 3*b*, and 3*c* of the second units 4*a*, 4*b*, and 4*c* includes three utilization units, namely, a first utilization unit 3*a*, a second utilization unit 3*b*, and a third utilization unit 3*c*. The plurality of branch units 6*a*, 6*b*, and 6*c* of the second units 4*a*, 4*b*, and 4*c* includes three branch units, namely, the first branch unit 6*a*, the second branch unit 6*b*, and the third branch unit 6*c*.

In the refrigeration system 1, the utilization units 3*a*, 3*b*, and 3*c* are configured to individually execute a cooling operation or a heating operation, and a utilization unit executing the heating operation can send a refrigerant to a utilization unit executing the cooling operation to achieve heat recovery between the utilization units. Specifically, heat is recovered in the present embodiment by executing a cooling main operation or a heating main operation of simultaneously executing the cooling operation and the heating operation. In addition, the refrigeration system 1 is configured to balance thermal loads of the cascade unit 2 in accordance with entire thermal loads of the plurality of utilization units 3*a*, 3*b*, and 3*c* in consideration of the heat recovery (the cooling main operation or the heating main operation).

(2) First Circuit

The first circuit 5*a* includes a first compressor 71, a first switching mechanism 72, the first heat exchanger 74, a first expansion valve 76, a first subcooling heat exchanger 103, a first subcooling circuit 104, a first subcooling expansion valve 104*a*, a second shutoff valve 108, a second expansion valve 102, the cascade heat exchanger 35 shared with the second circuit 10, a first shutoff valve 109, a first accumulator 105, the first pipe P1, and the second pipe P2. The first circuit 5*a* includes a first flow path 35*b* of the cascade heat exchanger 35.

The first pipe P1 is a pipe extending from a gas side of the first flow path 35*b* of the cascade heat exchanger 35 to the first heat exchanger 74. Here, the first pipe P1 is a gas pipe. The gas pipe is a pipe through which a refrigerant in a gas state or a gas-liquid two-phase state flows. The first pipe P1 includes the first connection pipe 112, a first refrigerant pipe 113 between the first connection pipe 112 and the cascade heat exchanger 35, and a pipe in the first unit 5.

The second pipe P2 is a pipe extending from a liquid side of the first flow path 35*b* of the cascade heat exchanger 35 to the first heat exchanger 74. Here, the second pipe P2 is a liquid pipe. The liquid pipe is a pipe through which a refrigerant in a liquid state, a gas-liquid two-phase state, or a supercritical state flows. The second pipe P2 includes the second connection pipe 111, a second refrigerant pipe 114 between the second connection pipe 111 and the cascade heat exchanger 35, and the pipe in the first unit 5.

The first circuit 5*a* includes a first connecting portion C1 (see FIG. 9) for connecting the first pipe P1 and the second pipe P2 extending from the cascade heat exchanger 35, of the first pipe P1 and the second pipe P2 connecting the first heat exchanger 74 and the cascade heat exchanger 35, to the first pipe P1 and the second pipe P2 extending from the first heat exchanger 74 inside or outside the cascade casing 2*x*. Here, the first circuit 5*a* includes first connecting portions C11 and C12 for connecting the first refrigerant pipe 113 and the second refrigerant pipe 114 extending from the cascade heat exchanger 35, of the first pipe P1 and the second pipe P2 connecting the first heat exchanger 74 and the cascade heat exchanger 35, to the first connection pipe 112 and the second connection pipe 111 inside or outside the cascade casing 2*x*.

The first compressor 71 is configured to compress a first refrigerant, and includes, for example, a scroll type or another positive-displacement compressor whose operating capacity can be varied by controlling an inverter for a compressor motor 71*a*.

The first accumulator 105 is provided at a halfway portion of a suction flow path connecting the first switching mechanism 72 and a suction side of the first compressor 71.

In a case where the cascade heat exchanger 35 functions as an evaporator for the first refrigerant, the first switching mechanism 72 enters a fifth connecting state of connecting the suction side of the first compressor 71 and a gas side of the first flow path 35*b* of the cascade heat exchanger 35 (see the solid lines of the first switching mechanism 72 in FIG. 1). In another case where the cascade heat exchanger 35 functions as a radiator for the first refrigerant, the first switching mechanism 72 comes into a sixth connecting state of connecting a discharge side of the first compressor 71 and the gas side of the first flow path 35*b* of the cascade heat exchanger 35 (see broken lines in the first switching mechanism 72 in FIG. 1). The first switching mechanism 72 is thus configured to switch the flow path of the refrigerant in the first circuit 5*a*, and includes, for example, a four-way switching valve. By changing a switching state of the first switching mechanism 72, the cascade heat exchanger 35 can function as the evaporator or the radiator for the first refrigerant.

The cascade heat exchanger 35 is configured to cause heat exchange between the first refrigerant such as R32 or R410A and a second refrigerant such as carbon dioxide without mixing the refrigerants. The cascade heat exchanger 35 includes, for example, a plate heat exchanger. The cascade heat exchanger 35 includes a second flow path 35*a* belonging to the second circuit 10, and the first flow path 35*b* belonging to the first circuit 5*a*. The second flow path 35*a* has a gas side connected to a second switching mechanism 22 via a third heat source pipe 25, and a liquid side connected to a heat source-side expansion valve 36 via a fourth heat source pipe 26. The gas side of the first flow path 35*b* is connected to the first compressor 71 via the first pipe P1 (specifically, the first refrigerant pipe 113, the first connection pipe 112, the first shutoff valve 109, and the first switching mechanism 72), and the liquid side of the first flow path 35*b* is connected to the second pipe P2 (specifically, the second refrigerant pipe 114 provided with the second expansion valve 102).

The first heat exchanger 74 is configured to exchange heat between the first refrigerant and outdoor air. In the first heat exchanger 74, the first refrigerant acquires cooling energy or heating energy from the outdoor air. The first heat exchanger 74 has a gas side connected to the first pipe P1 extending from the first switching mechanism 72. The first heat exchanger 74 includes, for example, a fin-and-tube heat exchanger constituted by large numbers of heat transfer tubes and fins.

The first expansion valve 76 is provided on the second pipe P2 extending from a liquid side of the first heat exchanger 74 to the first subcooling heat exchanger 103. The first expansion valve 76 is an electrically powered expansion valve that has an adjustable opening degree and adjusts a flow rate of the first refrigerant flowing in a portion at a liquid side of the first circuit 5*a*.

The first subcooling circuit 104 branches from a portion between the first expansion valve 76 and the first subcooling heat exchanger 103, and is connected to a portion between the first switching mechanism 72 and the first accumulator 105 on the suction flow path. The first subcooling expansion valve 104*a* is an electrically powered expansion valve that is provided upstream of the first subcooling heat exchanger 103 in the first subcooling circuit 104, has an adjustable opening degree, and adjusts the flow rate of the first refrigerant.

The first subcooling heat exchanger 103 is configured to cause heat exchange between a refrigerant flowing from the first expansion valve 76 toward the second shutoff valve 108 and a refrigerant decompressed at the first subcooling expansion valve 104*a* in the first subcooling circuit 104.

The first connection pipe 112 is a pipe that connects the first unit 5 and the cascade unit 2. The second connection pipe 111 is a pipe that connects the first unit 5 and the cascade unit 2.

The second expansion valve 102 is provided in the second refrigerant pipe 114. The second expansion valve 102 is an electrically powered expansion valve that has an adjustable opening degree and adjusts the flow rate of the first refrigerant flowing through the first flow path 35*b* of the cascade heat exchanger 35 and the like.

The first shutoff valve 109 is provided between the first connection pipe 112 and the first switching mechanism 72.

The second shutoff valve 108 is provided between the second connection pipe 111 and the first subcooling heat exchanger 103.

(3) Second Circuit (3-1) Outline of Second Circuit

The second circuit 10 includes the plurality of utilization units 3*a*, 3*b*, and 3*c*, the plurality of branch units 6*a*, 6*b*, and 6*c*, and the cascade unit 2, which are connected to each other. Each of the utilization units 3*a*, 3*b*, and 3*c* is connected to a corresponding one of the branch units 6*a*, 6*b*, and 6*c* on one-on-one basis. Specifically, the utilization unit 3*a* and the branch unit 6*a* are connected via the first connecting tube 15*a* and the second connecting tube 16*a*, the utilization unit 3*b* and the branch unit 6*b* are connected via the first connecting tube 15*b* and the second connecting tube 16*b*, and the utilization unit 3*c* and the branch unit 6*c* are connected via the first connecting tube 15*c* and the second connecting tube 16*c*. Each of the branch units 6*a*, 6*b*, and 6*c* is connected to the cascade unit 2 via three connection pipes, namely, the third connection pipe 7, the fourth connection pipe 8, and the fifth connection pipe 9. Specifically, the third connection pipe 7, the fourth connection pipe 8, and the fifth connection pipe 9 extending from the cascade unit 2 are each branched into a plurality of pipes and connected to each of the branch units 6*a*, 6*b*, and 6*c*.

The third connection pipe 7 has a flow of either the refrigerant in the gas-liquid two-phase state or the refrigerant in the liquid state in accordance with an operating state. Depending on the type of the second refrigerant, the third connection pipe 7 has a flow of the refrigerant in the supercritical state in accordance with the operating state. The fourth connection pipe 8 has a flow of either the refrigerant in the gas-liquid two-phase state or the refrigerant in the gas state in accordance with the operating state. Depending on the type of the second refrigerant, the fourth connection pipe 8 has a flow of the refrigerant in the supercritical state in accordance with the operating state. The fifth connection pipe 9 has a flow of either the refrigerant in the gas-liquid two-phase state or the refrigerant in the gas state in accordance with the operating state.

The second circuit 10 includes a heat source circuit 12, branch circuits 14*a*, 14*b*, and 14*c*, and utilization circuits 13*a*, 13*b*, and 13*c*, which are connected to each other.

(3-2) Heat Source Circuit

The heat source circuit 12 mainly includes a second compressor 21, the second switching mechanism 22, a first heat source pipe 28, a second heat source pipe 29, a suction flow path 23, a discharge flow path 24, the third heat source pipe 25, the fourth heat source pipe 26, a fifth heat source pipe 27, the cascade heat exchanger 35, the heat source-side expansion valve 36, a third shutoff valve 32, a fourth shutoff valve 33, a fifth shutoff valve 31, a second accumulator 30, an oil separator 34, an oil return circuit 40, a second receiver 45, a bypass circuit 46, a bypass expansion valve 46*a*, a second subcooling heat exchanger 47, a second subcooling circuit 48, and a second subcooling expansion valve 48*a*. The heat source circuit 12 of the second circuit 10 includes the second flow path 35*a* of the cascade heat exchanger 35.

The second compressor 21 is configured to compress the second refrigerant in the heat source circuit 12 of the second circuit, and includes, for example, a scroll type or another positive-displacement compressor whose operating capacity can be varied by controlling an inverter for a compressor motor 21*a*. The second compressor 21 is controlled in accordance with an operating load so as to have larger operating capacity as the load increases.

The second switching mechanism 22 is configured to switch a connecting state of the second refrigerant circuit 10, specifically, the flow path of the refrigerant in the heat source circuit 12. The second switching mechanism 22 according to the present embodiment includes a discharge-side connection portion 22*x*, a suction-side connection portion 22*y*, a first switching valve 22*a*, and a second switching valve 22*b*. An end of the discharge flow path 24 on a side opposite to the second compressor 21 is connected to the discharge-side connection portion 22*x*. An end of the suction flow path 23 on a side opposite to the second compressor 21 is connected to the suction-side connection portion 22*y*. The first switching valve 22*a* and the second switching valve 22*b* are provided in parallel to each other between the discharge flow path 24 and the suction flow path 23 of the second compressor 21. The first switching valve 22*a* is connected to one end of the discharge-side connection portion 22*x* and one end of the suction-side connection portion 22*y*. The second switching valve 22*b* is connected to the other end of the discharge-side connection portion 22*x* and the other end of the suction-side connection portion 22*y*. In the present embodiment, each of the first switching valve 22*a* and the second switching valve 22*b* includes the four-way switching valve. Each of the first switching valve 22*a* and the second switching valve 22*b* has four connection ports, namely, a first connection port, a second connection port, a third connection port, and a fourth connection port. In the first switching valve 22*a* and the second switching valve 22*b* according to the present embodiment, each of the fourth ports is closed and is a connection port not connected to the flow path of the second circuit 10. In the first switching valve 22*a*, the first connection port is connected to the one end of the discharge-side connection portion 22*x*, the second connection port is connected to the third heat source pipe 25 extending from the second flow path 35*a* of the cascade heat exchanger 35, and the third connection port is connected to the one end of the suction-side connection portion 22*y*. The first switching valve 22*a* switches between a switching state in which the first connection port and the second connection port are connected and the third connection port and the fourth connection port are connected and a switching state in which the third connection port and the second connection port are connected and the first connection port and the fourth connection port are connected. The second switching valve 22*b* has the first connection port connected to the other end of the discharge-side connection portion 22*x*, the second connection port connected to the first heat source pipe 28, and the third connection port connected to the other end of the suction-side connection portion 22*y*. The second switching valve 22*b* switches between a switching state in which the first connection port and the second connection port are connected and the third connection port and the fourth connection port are connected and a switching state in which the third connection port and the second connection port are connected and the first connection port and the fourth connection port are connected.

When the second refrigerant discharged from the second compressor 21 is prevented from being sent to the fourth connection pipe 8 while the cascade heat exchanger 35 functions as a radiator for the second refrigerant, the second switching mechanism 22 is switched to a first connecting state in which the discharge flow path 24 and the third heat source pipe 25 are connected by the first switching valve 22*a* and the first heat source pipe 28 and the suction flow path 23 are connected by the second switching valve 22*b*. The first connecting state of the second switching mechanism 22 is a connecting state adopted during the cooling operation described later. When the cascade heat exchanger 35 functions as an evaporator for the second refrigerant, the second switching mechanism 22 is switched to a second connecting state in which the discharge flow path 24 and the first heat source pipe 28 are connected by the second switching valve 22*b* and the third heat source pipe 25 and the suction flow path 23 are connected by the first switching valve 22*a*. The second connecting state of the second switching mechanism 22 is a connecting state adopted during the heating operation and during the heating main operation described later. When the second refrigerant discharged from the second compressor 21 is sent to the fourth connection pipe 8 while the cascade heat exchanger 35 functions as a radiator for the second refrigerant, the second switching mechanism 22 is switched to a third connecting state in which the discharge flow path 24 and the third heat source pipe 25 are connected by the first switching valve 22*a* and the discharge flow path 24 and the first heat source pipe 28 are connected by the second switching valve 22*b*. The third connecting state of the second switching mechanism 22 is a connecting state adopted during the cooling main operation described later.

Figure 7:
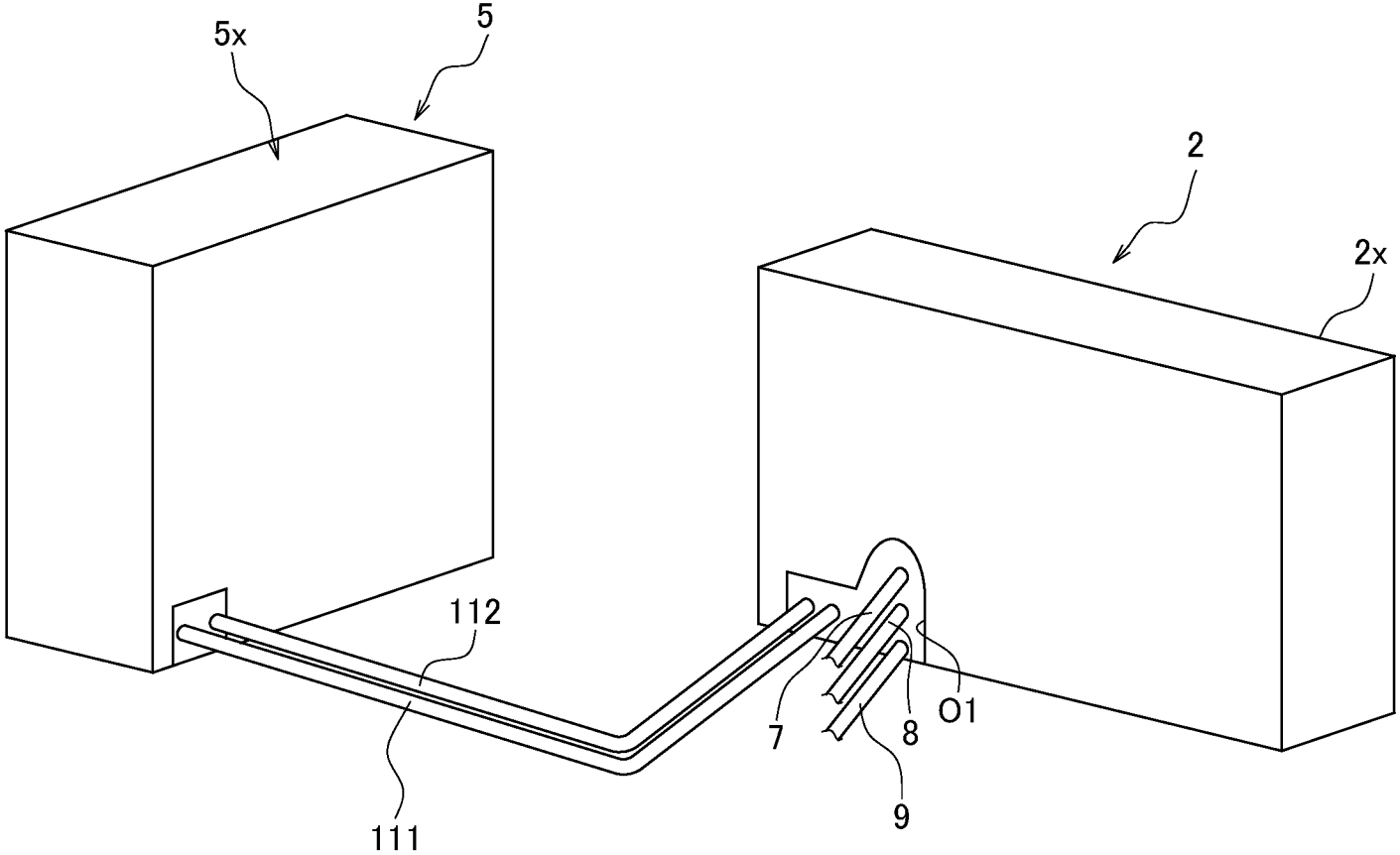
FIG. 7 is a schematic diagram illustrating connection between a first unit and a cascade unit.

As described above, the cascade heat exchanger 35 is configured to cause heat exchange between the first refrigerant, such as R32, flowing in the first circuit 5*a* and the second refrigerant, such as carbon dioxide, flowing in the second circuit 10 without mixing the refrigerants. The cascade heat exchanger 35 includes the second flow path 35*a* having a flow of the second refrigerant in the second circuit 10 and the first flow path 35*b* having a flow of the first refrigerant in the first circuit 5*a*, so as to be shared between the first unit 5 and the cascade unit 2. Note that in the present embodiment, as shown in FIG. 7, the cascade heat exchanger 35 is disposed inside a cascade casing 2*x* of the cascade unit 2. The gas side of the first flow path 35*b* of the cascade heat exchanger 35 extends to the first connection pipe 112 outside the cascade casing 2*x* via the first refrigerant pipe 113. The liquid side of the first flow path 35*b* of the cascade heat exchanger 35 extends to the second connection pipe 111 outside the cascade casing 2*x* via the second refrigerant pipe 114 provided with the second expansion valve 102.

The heat source-side expansion valve 36 is an electrically powered expansion valve having an adjustable opening degree and connected to a liquid side of the cascade heat exchanger 35, in order for control and the like of a flow rate of the second refrigerant flowing in the cascade heat exchanger 35. The heat source-side expansion valve 36 is provided on the fourth heat source pipe 26.

Each of the third shutoff valve 32, the fourth shutoff valve 33, and the fifth shutoff valve 31 is provided at a connecting port with an external device or pipe (specifically, the connection pipes 7, 8, and 9). Specifically, the third shutoff valve 32 is connected to the fourth connection pipe 8 led out of the cascade unit 2. The fourth shutoff valve 33 is connected to the fifth connection pipe 9 led out of the cascade unit 2. The fifth shutoff valve 31 is connected to the third connection pipe 7 led out of the cascade unit 2.

The first heat source pipe 28 is a refrigerant pipe that connects the third shutoff valve 32 and the second switching mechanism 22. Specifically, the first heat source pipe 28 connects the third shutoff valve 32 and the second connection port of the second switching valve 22*b* of the second switching mechanism 22.

The suction flow path 23 connects the second switching mechanism 22 and the suction side of the second compressor 21. Specifically, the suction flow path 23 connects the suction-side connection portion 22*y* of the second switching mechanism 22 and the suction side of the second compressor 21. The second accumulator 30 is provided at a halfway portion of the suction flow path 23.

The second heat source pipe 29 is a refrigerant pipe that connects the fourth shutoff valve 33 and another halfway portion of the suction flow path 23. Note that, in the present embodiment, the second heat source pipe 29 is connected to the suction flow path 23 at a connection point of the suction flow path 23 between the suction-side connection portion 22*y* of the second switching mechanism 22 and the second accumulator 30.

The discharge flow path 24 is a refrigerant pipe that connects the discharge side of the second compressor 21 and the second switching mechanism 22. Specifically, the discharge flow path 24 connects the discharge side of the second compressor 21 and the discharge-side connection portion 22*x* of the second switching mechanism 22.

The third heat source pipe 25 is a refrigerant pipe that connects the second switching mechanism 22 and a gas side of the cascade heat exchanger 35. Specifically, the third heat source pipe 25 connects the second connection port of the first switching valve 22*a* of the second switching mechanism 22 and a gas-side end of the second flow path 35*a* in the cascade heat exchanger 35.

The fourth heat source pipe 26 is a refrigerant pipe that connects the liquid side (the side opposite to the gas side, that is, the side opposite to the side on which the second switching mechanism 22 is provided) of the cascade heat exchanger 35 and the second receiver 45. Specifically, the fourth heat source pipe 26 connects a liquid side end (side end opposite to the gas side) of the second flow path 35*a* in the cascade heat exchanger 35 and the second receiver 45.

The second receiver 45 is a refrigerant reservoir that reserves a residue refrigerant in the second refrigerant circuit 10. The second receiver 45 is provided with the fourth heat source pipe 26, the fifth heat source pipe 27, and the bypass circuit 46 extending outward.

The bypass circuit 46 is a refrigerant pipe that connects a gas phase region corresponding to an upper region in the second receiver 45 and the suction flow path 23. Specifically, the bypass circuit 46 is connected between the second switching mechanism 22 and the second accumulator 30 on the suction flow path 23. The bypass circuit 46 is provided with the bypass expansion valve 46*a*. The bypass expansion valve 46*a* is an electrically powered expansion valve having an adjustable opening degree to adjust quantity of the refrigerant guided from inside the second receiver 45 to the suction side of the second compressor 21.

The fifth heat source pipe 27 is a refrigerant pipe that connects the second receiver 45 and the fifth shutoff valve 31.

The second subcooling circuit 48 is a refrigerant pipe that connects a part of the fifth heat source pipe 27 and the suction flow path 23. Specifically, the second subcooling circuit 48 is connected between the second switching mechanism 22 and the second accumulator 30 on the suction flow path 23. The second subcooling circuit 48 according to the present embodiment extends to branch from a portion between the second receiver 45 and the second subcooling heat exchanger 47.

The second subcooling heat exchanger 47 is configured to cause heat exchange between the refrigerant flowing in a flow path belonging to the fifth heat source pipe 27 and the refrigerant flowing in a flow path belonging to the second subcooling circuit 48. The subcooling heat exchanger 47 according to the present embodiment is provided between a portion from where the second subcooling circuit 48 branches and the fifth shutoff valve 31 on the fifth heat source pipe 27. The second subcooling expansion valve 48*a* is provided between a portion branching from the fifth heat source pipe 27 and the second subcooling heat exchanger 47 on the second subcooling circuit 48. The second subcooling expansion valve 48*a* supplies the second subcooling heat exchanger 47 with a decompressed refrigerant, and is an electrically powered expansion valve having an adjustable opening degree.

The second accumulator 30 is a container that can store the second refrigerant, and is provided on the suction side of the second compressor 21.

The oil separator 34 is provided at a halfway portion of the discharge flow path 24. The oil separator 34 is configured to separate, from the second refrigerant, refrigerating machine oil discharged from the second compressor 21 along with the second refrigerant and return the refrigerating machine oil to the second compressor 21.

The oil return circuit 40 is provided to connect the oil separator 34 and the suction flow path 23. The oil return circuit 40 includes an oil return flow path 41 in which a flow path extending from the oil separator 34 extends to join a portion of the suction flow path 23 between the second accumulator 30 and the suction side of the second compressor 21. An oil return on-off valve 44 is provided at a halfway portion of the oil return flow path 41. When the oil return on-off valve 44 is controlled into an opened state, the refrigerating machine oil separated in the oil separator 34 passes the oil return flow path 41 and is returned to the suction side of the second compressor 21. When the second compressor 21 is in the operating state in the second refrigerant circuit 10, the oil return on-off valve 44 according to the present embodiment is kept in the opened state for predetermined time and is kept in a closed state for predetermined time repeatedly, to control returned quantity of the refrigerating machine oil through the oil return circuit 40. In the present embodiment, the oil return on-off valve 44 is an electromagnetic valve that is controlled to open and close, but may be an electrically powered expansion valve having an adjustable opening degree.

(3-3) Utilization Circuit

Description is made below to the utilization circuits 13*a*, 13*b*, and 13*c*. Since the utilization circuits 13*b* and 13*c* are configured similarly to the utilization circuit 13*a*, elements of the utilization circuits 13*b* and 13*c* will not be described repeatedly, assuming that a subscript "b" or "c" will replace a subscript "a" in reference signs denoting elements of the utilization circuit 13*a*.

The utilization circuit 13*a* mainly includes the second heat exchanger 52*a*, a first utilization pipe 57*a*, a second utilization pipe 56*a*, and a utilization-side expansion valve 51*a*.

The second heat exchanger 52*a* is configured to exchange heat between the refrigerant and indoor air, and includes a fin-and-tube heat exchanger constituted by large numbers of heat transfer tubes and fins. The plurality of second heat exchangers 52*a*, 52*b*, and 52*c* are connected in parallel to the second switching mechanism 22, the suction flow path 23, and the cascade heat exchanger 35.

The second utilization pipe 56*a* has one end connected to a liquid side (opposite to a gas side) of the second heat exchanger 52*a* in the first utilization unit 3*a*. The second utilization pipe 56*a* has the other end connected to the second connecting tube 16*a*. The second utilization pipe 56*a* has a halfway portion provided with the utilization-side expansion valve 51*a* described above.

The utilization-side expansion valve 51*a* is an electrically powered expansion valve that has an adjustable opening degree and adjusts a flow rate of the refrigerant flowing in the second heat exchanger 52*a*. The utilization-side expansion valve 51*a* is provided on the second utilization pipe 56*a*.

The first utilization pipe 57*a* has one end connected to the gas side of the second heat exchanger 52*a* in the first utilization unit 3*a*. The first utilization pipe 57*a* according to the present embodiment is connected to a portion opposite to the utilization-side expansion valve 51*a* of the second heat exchanger 52*a*. The first utilization pipe 57*a* has the other end connected to the first connecting tube 15*a*.

(3-4) Branch Circuit

Description is made below to the branch circuits 14*a*, 14*b*, and 14*c*. Since the branch circuits 14*b* and 14*c* are configured similarly to the branch circuit 14*a*, elements of the branch circuits 14*b* and 14*c* will not be described repeatedly, assuming that a subscript "b" or "c" will replace a subscript "a" in reference signs denoting elements of the branch circuit 14*a*.

The branch circuit 14*a* mainly includes a junction pipe 62*a*, a first branch pipe 63*a*, a second branch pipe 64*a*, a first control valve 66*a*, a second control valve 67*a*, a bypass pipe 69*a*, a check valve 68*a*, and a third branch pipe 61*a*.

The junction pipe 62*a* has one end connected to the first connecting tube 15*a*. The other end of the junction pipe 62*a* is connected to the first branch pipe 63*a* and the second branch pipe 64*a* which are branched.

The first branch pipe 63*a* has a portion opposite to the junction pipe 62 and connected to the fourth connection pipe 8. The first branch pipe 63*a* is provided with the openable and closable first control valve 66*a*.

The second branch pipe 64*a* has a portion opposite to the junction pipe 62 and connected to the fifth connection pipe 9. The second branch pipe 64*a* is provided with the openable and closable second control valve 67*a*.

The bypass pipe 69*a* is a refrigerant pipe that connects a portion of the first branch pipe 63*a* closer to the fourth connection pipe 8 than the first control valve 66*a* and a portion of the second branch pipe 64*a* closer to the fifth connection pipe 9 than the second control valve 67*a*. The check valve 68*a* is provided in a halfway portion of the bypass pipe 69*a*. The check valve 68*a* allows only a refrigerant flow from the second branch pipe 64*a* toward the first branch pipe 63*a*, and does not allow a refrigerant flow from the first branch pipe 63*a* toward the second branch pipe 64*a*.

The third branch pipe 61*a* has one end connected to the second connecting tube 16*a*. The other end of the third branch pipe 61*a* is connected to the third connection pipe 7.

Then, the first branch unit 6*a* can function as follows by closing the first control valve 66*a* and opening the second control valve 67*a* when the cooling operation described later is performed. The first branch unit 6*a* sends the refrigerant flowing into the third branch pipe 61*a* through the third connection pipe 7 to the second connecting tube 16*a*. The refrigerant flowing in the second utilization pipe 56*a* in the first utilization unit 3*a* via the second connecting tube 16*a* is sent to the second heat exchanger 52*a* in the first utilization unit 3*a* via the utilization-side expansion valve 51*a*. Then, the refrigerant sent to the second heat exchanger 52*a* is evaporated by heat exchange with indoor air, and then flows in the first connecting tube 15*a* via the first utilization pipe 57*a*. The refrigerant having flowed through the first connecting tube 15*a* is sent to the junction pipe 62*a* of the first branch unit 6*a*. The refrigerant having flowed through the junction pipe 62*a* does not flow toward the first branch pipe 63*a* but flows toward the second branch pipe 64*a*. The refrigerant flowing in the second branch pipe 64*a* passes through the second control valve 67*a*. A part of the refrigerant that has passed through the second control valve 67*a* is sent to the fifth connection pipe 9. A remaining part of the refrigerant that has passed through the second control valve 67*a* flows so as to branch into the bypass pipe 69*a* provided with the check valve 68*a*, passes through a part of the first branch pipe 63*a*, and then is sent to the fourth connection pipe 8. As a result, it is possible to increase a total flow path cross-sectional area when the gas-state second refrigerant evaporated in the second heat exchanger 52*a* is sent to the second compressor 21, so that pressure loss can be reduced.

When the first utilization unit 3*a* cools a room at the time of performing the cooling main operation and the heating main operation to be described later, the first branch unit 6*a* can function as follows by closing the first control valve 66*a* and opening the second control valve 67*a*. The first branch unit 6*a* sends the refrigerant flowing into the third branch pipe 61*a* through the third connection pipe 7 to the second connecting tube 16*a*. The refrigerant flowing in the second utilization pipe 56*a* in the first utilization unit 3*a* via the second connecting tube 16*a* is sent to the second heat exchanger 52*a* in the first utilization unit 3*a* via the utilization-side expansion valve 51*a*. Then, the refrigerant sent to the second heat exchanger 52*a* is evaporated by heat exchange with indoor air, and then flows in the first connecting tube 15*a* via the first utilization pipe 57*a*. The refrigerant having flowed through the first connecting tube 15*a* is sent to the junction pipe 62*a* of the first branch unit 6*a*. The refrigerant having flowed through the junction pipe 62*a* flows into the second branch pipe 64*a*, passes through the second control valve 67*a*, and is sent to the fifth connection pipe 9.

The first branch unit 6*a* can function as follows by closing the second control valve 67*a* and opening the first control valve 66*a* when the heating operation described later is performed. In the first branch unit 6*a*, the refrigerant flowing into the first branch pipe 63*a* through the fourth connection pipe 8 passes through the first control valve 66*a* and is sent to the junction pipe 62*a*. The refrigerant having flowed through the junction pipe 62*a* flows in the first utilization pipe 57*a* in the utilization unit 3*a* via the first connecting tube 15*a* to be sent to the second heat exchanger 52*a*. Then, the refrigerant sent to the second heat exchanger 52*a* radiates heat through heat exchange with indoor air, and then passes through the utilization-side expansion valve 51*a* provided on the second utilization pipe 56*a*. The refrigerant having passed through the second utilization pipe 56*a* flows through the third branch pipe 61*a* of the first branch unit 6*a* via the second connecting tube 16*a*, and is sent to the third connection pipe 7.

When the first utilization unit 3*a* heats a room at the time of performing the cooling main operation and the heating main operation described later, the first branch unit 6*a* can function as follows by closing the second control valve 67*a* and opening the first control valve 66*a*. In the first branch unit 6*a*, the refrigerant flowing into the first branch pipe 63*a* through the fourth connection pipe 8 passes through the first control valve 66*a* and is sent to the junction pipe 62*a*. The refrigerant having flowed through the junction pipe 62*a* flows in the first utilization pipe 57*a* in the utilization unit 3*a* via the first connecting tube 15*a* to be sent to the second heat exchanger 52*a*. Then, the refrigerant sent to the second heat exchanger 52*a* radiates heat through heat exchange with indoor air, and then passes through the utilization-side expansion valve 51*a* provided on the second utilization pipe 56*a*. The refrigerant having passed through the second utilization pipe 56*a* flows through the third branch pipe 61*a* of the first branch unit 6*a* via the second connecting tube 16*a*, and is sent to the third connection pipe 7.

The first branch unit 6*a*, as well as the second branch unit 6*b* and the third branch unit 6*c*, similarly have such a function. Accordingly, the first branch unit 6*a*, the second branch unit 6*b*, and the third branch unit 6*c* can individually switchably cause the second heat exchangers 52*a*, 52*b*, and 52*c* to function as a refrigerant evaporator or a refrigerant radiator.

(3-5) Liquid Pipe and Gas Pipe

As described above, the second circuit 10 includes the liquid pipe P3 and the gas pipes P4 and P5 that connect the second heat exchangers 52*a*, 52*b*, and 52*c* and the cascade heat exchanger 35. The gas pipes according to the present embodiment are the first gas pipe P4 and the second gas pipe P5.

The liquid pipe P3 is a pipe extending from the liquid side of the second flow path 35*a* of the cascade heat exchanger 35 to the second heat exchangers 52*a*, 52*b*, and 52*c*. The liquid pipe is a pipe through which a refrigerant in a liquid state, a gas-liquid two-phase state, or a supercritical state flows.

The liquid pipe P3 according to the present embodiment is connected to the fifth shutoff valve 31. Specifically, the liquid pipe P3 includes the third connection pipe 7, the fourth heat source pipe 26, the fifth heat source pipe 27, the second connecting tubes 16*a*, 16*b*, and 16*c*, the second utilization pipes 56*a*, 56*b*, and 56*c*, and the third branch pipes 61*a*, 61*b*, and 61*c*.

The gas pipes P4 and P5 are pipes extending from the gas side of the second flow path 35*a* of the cascade heat exchanger 35 to the second heat exchangers 52*a*, 52*b*, and 52*c*. The gas pipes P4 and P5 are pipes through which the refrigerant in the gas state or the gas-liquid two-phase state flows.

The first gas pipe P4 according to the present embodiment is connected to the third shutoff valve 32. Specifically, the first gas pipe P4 includes the fourth connection pipe 8, the third heat source pipe 25, the first heat source pipe 28, the suction flow path 23, the discharge flow path 24, the first connecting tubes 15*a*, 15*b*, and 15*c*, first utilization pipes 57*a*, 57*b*, and 57*c*, junction pipes 62*a*, 62*b*, and 62*c*, first branch pipes 63*a*, 63*b*, and 63*c*, and bypass pipes 69*a*, 69*b*, and 69*c*.

The second gas pipe P5 according to the present embodiment is connected to the fourth shutoff valve 33. Specifically, the second gas pipe P5 includes the fifth connection pipe 9, the third heat source pipe 25, the second heat source pipe 29, the discharge flow path 24, the first connecting tubes 15*a*, 15*b*, 15*c*, the first utilization pipes 57*a*, 57*b*, 57*c*, the junction pipes 62*a*, 62*b*, 62*c*, and second branch pipes 64*a*, 64*b*, 64*c*.

The second circuit 10 includes a second connecting portion C2 (see FIG. 9) for connecting the liquid pipe P3 and the gas pipe P4 extending from the cascade heat exchanger 35, of the liquid pipe P3 and the gas pipe P4 connecting the second heat exchangers 52*a*, 52*b*, and 52*c* and the cascade heat exchanger 35, to the liquid pipe P3 and the gas pipe P4 extending from the second heat exchangers 52*a*, 52*b*, and 52*c* inside or outside the cascade casing 2*x*.

The second circuit 10 includes a second connecting portion C2 (see FIG. 9) for connecting to the liquid pipe P3 and the gas pipes P4 and P5 extending from the second heat exchangers 52*a*, 52*b*, and 52*c* inside or outside the cascade casing 2*x* (see FIGS. 7 and 8) among the liquid pipe P3 and the gas pipes P4 and P5. Here, the second circuit 10 includes a second connecting portion C21 for connecting the liquid pipe P3, a second connecting portion C22 for connecting the first gas pipe P4, and a second connecting portion C23 for connecting the second gas pipe P5.

(4) First Unit

The first unit 5 is disposed in a space different from a space in which the second units 4*a*, 4*b*, and 4*c* (specifically, the utilization units 3*a*, 3*b*, and 3*c* and the branch units 6*a*, 6*b*, and 6*c*) are disposed. Here, the first unit 5 is installed on a rooftop of the building.

The first unit 5 includes a part of the first circuit 5*a* described above, a first fan 75, various sensors, a first control unit 70, and a first casing 5*x* as shown in FIG. 7.

The first unit 5 includes, as a part of the first circuit 5*a*, the first compressor 71, the first switching mechanism 72, the first heat exchanger 74, the first expansion valve 76, the first subcooling heat exchanger 103, the first subcooling circuit 104, the first subcooling expansion valve 104*a*, the second shutoff valve 108, the first shutoff valve 109, the first accumulator 105, a part of the first pipe P1, and a part of the second pipe P2. The first unit 5 further includes the first casing 5*x* shown in FIG. 7.

The first casing 5*x* is a rectangular parallelepiped having a plurality of surfaces. The first casing 5*x* accommodates the first compressor 71, the first switching mechanism 72, the first heat exchanger 74, the first expansion valve 76, the first subcooling heat exchanger 103, the first subcooling circuit 104, the first subcooling expansion valve 104*a*, the second shutoff valve 108, the first shutoff valve 109, and the first accumulator 105. The first casing 5*x* accommodates a part of the first pipe P1 and a part of the second pipe P2. The first connection pipe 112 constituting the first pipe P1 and the second connection pipe 111 constituting the second pipe P2 extend from the first casing 5*x*.

The first fan 75 is provided in the first unit 5, and generates an air flow of guiding outdoor air into the first heat exchanger 74 and exhausting, to outdoors, air obtained after heat exchange with the first refrigerant flowing in the first heat exchanger 74. The first fan 75 is driven by a first fan motor 75*a*.

The first unit 5 is also provided with various sensors. Specifically, there are provided an outdoor air temperature sensor 77 that detects a temperature of outdoor air before passing through the first heat exchanger 74, a first discharge pressure sensor 78 that detects a pressure of the first refrigerant discharged from the first compressor 71, a first suction pressure sensor 79 that detects a pressure of the first refrigerant sucked into the first compressor 71, a first suction temperature sensor 81 that detects a temperature of the first refrigerant sucked into the first compressor 71, and a first heat exchange temperature sensor 82 that detects a temperature of the refrigerant flowing in the first heat exchanger 74.

The first control unit 70 controls behavior of the members 71 (71*a*), 72, 75 (75*a*), 76, and 104*a* provided in the first unit 5. The first control unit 70 includes a processor such as a CPU or a microcomputer and a memory provided to control the first unit 5. The first control unit can exchange control signals and the like with a remote controller (not shown), and exchange control signals and the like with a heat source-side control unit 20 of the cascade unit 2, branch unit control units 60*a*, 60*b*, and 60*c*, and utilization-side control units 50*a*, 50*b*, and 50*c*.

(5) Cascade Unit (5-1) Overview

The cascade unit 2 is disposed in a space different from the space in which the second units 4*a*, 4*b*, and 4*c* (specifically, the utilization units 3*a*, 3*b*, and 3*c* and the branch units 6*a*, 6*b*, and 6*c*) are disposed. Here, the cascade unit 2 is installed on a rooftop of the building.

The cascade unit 2 is connected to the branch units 6*a*, 6*b*, and 6*c* via the connection pipes 7, 8, and 9, to constitute a part of the second circuit 10. In addition, the cascade unit 2 is connected to the first unit 5 via the connection pipes 111 and 112, and constitutes a part of the first circuit 5*a*.

Figure 8:
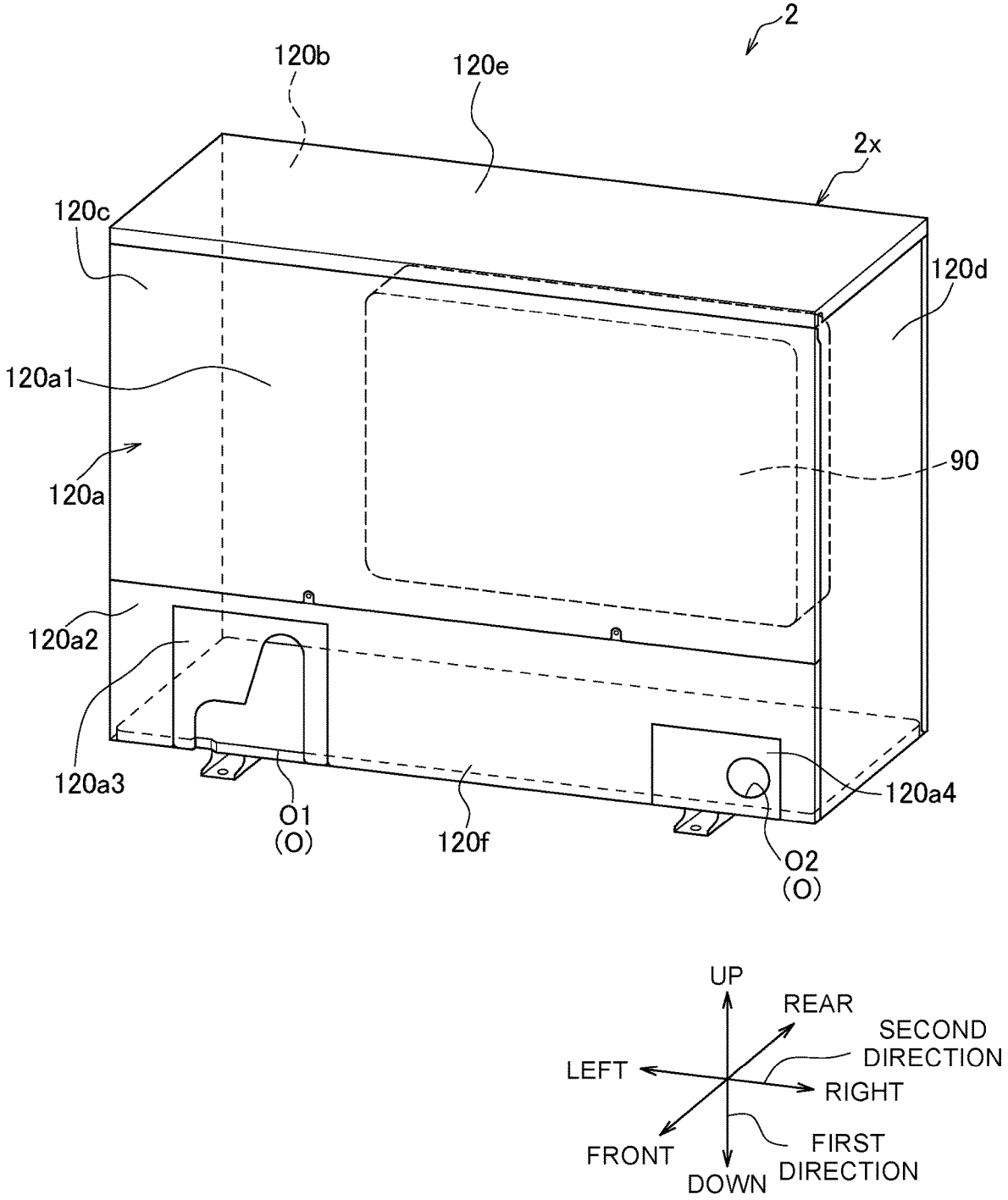
FIG. 8 is a perspective view illustrating a casing of the cascade unit.

The cascade unit 2 includes the heat source circuit 12, various sensors, the heat source-side control unit 20, a part of the first pipe P1 and a part of the second pipe P2 constituting the first circuit 5*a*, the second expansion valve 102, and the cascade casing 2*x* as shown in FIGS. 7 and 8.

The cascade unit 2 includes a second suction pressure sensor 37 that detects pressure of a second refrigerant on the suction side of the second compressor 21, a second discharge pressure sensor 38 that detects pressure of the second refrigerant on the discharge side of the second compressor 21, a second discharge temperature sensor 39 that detects temperature of the second refrigerant on the discharge side of the second compressor 21, a second suction temperature sensor 88 that detects temperature of the second refrigerant on the suction side of the second compressor 21, a cascade temperature sensor 83 that detects temperature of the second refrigerant flowing between the second flow path 35*a* of the cascade heat exchanger 35 and the heat source-side expansion valve 36, a receiver outlet temperature sensor 84 that detects temperature of the second refrigerant flowing between the second receiver 45 and the second subcooling heat exchanger 47, a bypass circuit temperature sensor 85 that detects temperature of the second refrigerant flowing downstream of the bypass expansion valve 46*a* in the bypass circuit 46, a subcooling outlet temperature sensor 86 that detects temperature of the second refrigerant flowing between the second subcooling heat exchanger 47 and the fifth shutoff valve 31, and a subcooling circuit temperature sensor 87 that detects temperature of the second refrigerant flowing through an outlet of the second subcooling heat exchanger 47 in the second subcooling circuit 48.

The heat source-side control unit 20 controls behavior of the members 21 (21*a*), 22, 36, 44, 46*a*, 48*a*, and 102 provided in the cascade casing 2*x* of the cascade unit 2. The heat source-side control unit 20 includes a processor such as a CPU or a microcomputer and a memory provided to control the cascade unit 2. The heat source control unit can exchange control signals and the like with the first control unit 70 of the first unit 5, the utilization-side control units 50*a*, 50*b*, and 50*c* of the utilization units 3*a*, 3*b*, and 3*c*, and the branch unit control units 60*a*, 60*b*, and 60*c*.

As described above, the heat source-side control unit 20 can control not only the members constituting the heat source circuit 12 of the second circuit 10 but also the second expansion valve 102 constituting a part of the first circuit 5*a*. Therefore, the heat source-side control unit 20 controls the valve opening degree of the second expansion valve 102 on the basis of a condition of the heat source circuit 12 controlled by the heat source-side control unit 20, so as to bring the condition of the heat source circuit 12 closer to a desired condition. Specifically, it is possible to control an amount of heat received by the second refrigerant flowing through the second flow path 35*a* of the cascade heat exchanger 35 in the heat source circuit 12 from the first refrigerant flowing through the first flow path 35*b* of the cascade heat exchanger 35 or an amount of heat given by the second refrigerant to the first refrigerant.

(5-2) Characteristic Parts (5-2-1) Cascade Casing

Figure 9:
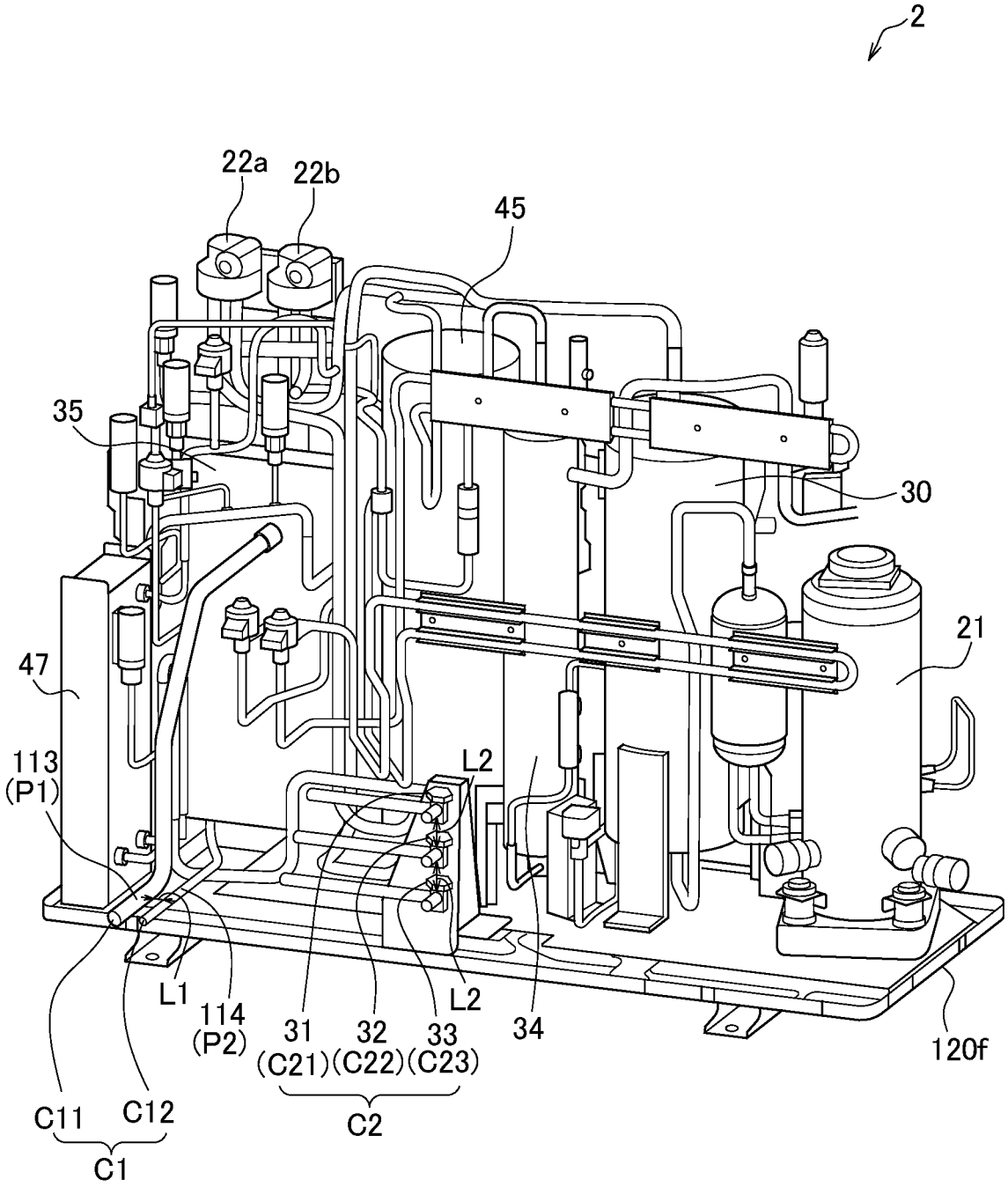
FIG. 9 is a perspective view illustrating an inside of the cascade unit.

The cascade casing 2*x* accommodates a part of the first circuit 5*a* and a part of the second circuit 10 shown in FIG. 9. In the present embodiment, a part of the first circuit 5*a* includes the second refrigerant pipe 114 which is a part of the second pipe P2, the second expansion valve 102, the first flow path 35*b* of the cascade heat exchanger 35, and the first refrigerant pipe 113 which is a part of the first pipe P1. A part of the second circuit 10 includes the second compressor 21, the second switching mechanism 22, the first heat source pipe 28, the second heat source pipe 29, the suction flow path 23, the discharge flow path 24, the third heat source pipe 25, the fourth heat source pipe 26, the fifth heat source pipe 27, the second flow path 35*a* of the cascade heat exchanger 35, the heat source-side expansion valve 36, the fifth shutoff valve 31, the third shutoff valve 32, the fourth shutoff valve 33, the second accumulator 30, the oil separator 34, the oil return circuit 40, the second receiver 45, the bypass circuit 46, the bypass expansion valve 46*a*, the second subcooling heat exchanger 47, the second subcooling circuit 48, and the second subcooling expansion valve 48*a*. Furthermore, the cascade casing 2*x* accommodates an electric component 90 that drives the second compressor 21.

The third connection pipe 7, the fourth connection pipe 8, and the fifth connection pipe 9 as a part of the second circuit 10 extend from the cascade casing 2*x*. The second connection pipe 111 and the first connection pipe 112 as a part of the first circuit 5*a* extend from the cascade casing 2*x*.

As shown in FIG. 8, the cascade casing 2*x* is a rectangular parallelepiped having an upper surface 120*e*, a bottom surface 120*f*, and side surfaces. The upper surface 120*e* and the bottom surface 120*f* face each other. The cascade casing 2*x* has a front surface 120*a*, a rear surface 120*b*, a left surface 120*c*, and a right surface 120*d* as four side surfaces. The front surface 120*a* and the rear surface 120*b* face each other. The left surface 120*c* and the right surface 120*d* face each other.

In the present embodiment, the cascade casing 2*x* includes a front plate constituting the front surface 120*a*, a rear plate constituting the rear surface 120*b*, a left plate constituting the left surface 120*c*, a right plate constituting the right surface 120*d*, an upper plate constituting the upper surface 120*e*, and a bottom plate constituting the bottom surface 120*f*. The bottom plate has a rectangular shape.

Figure 10:
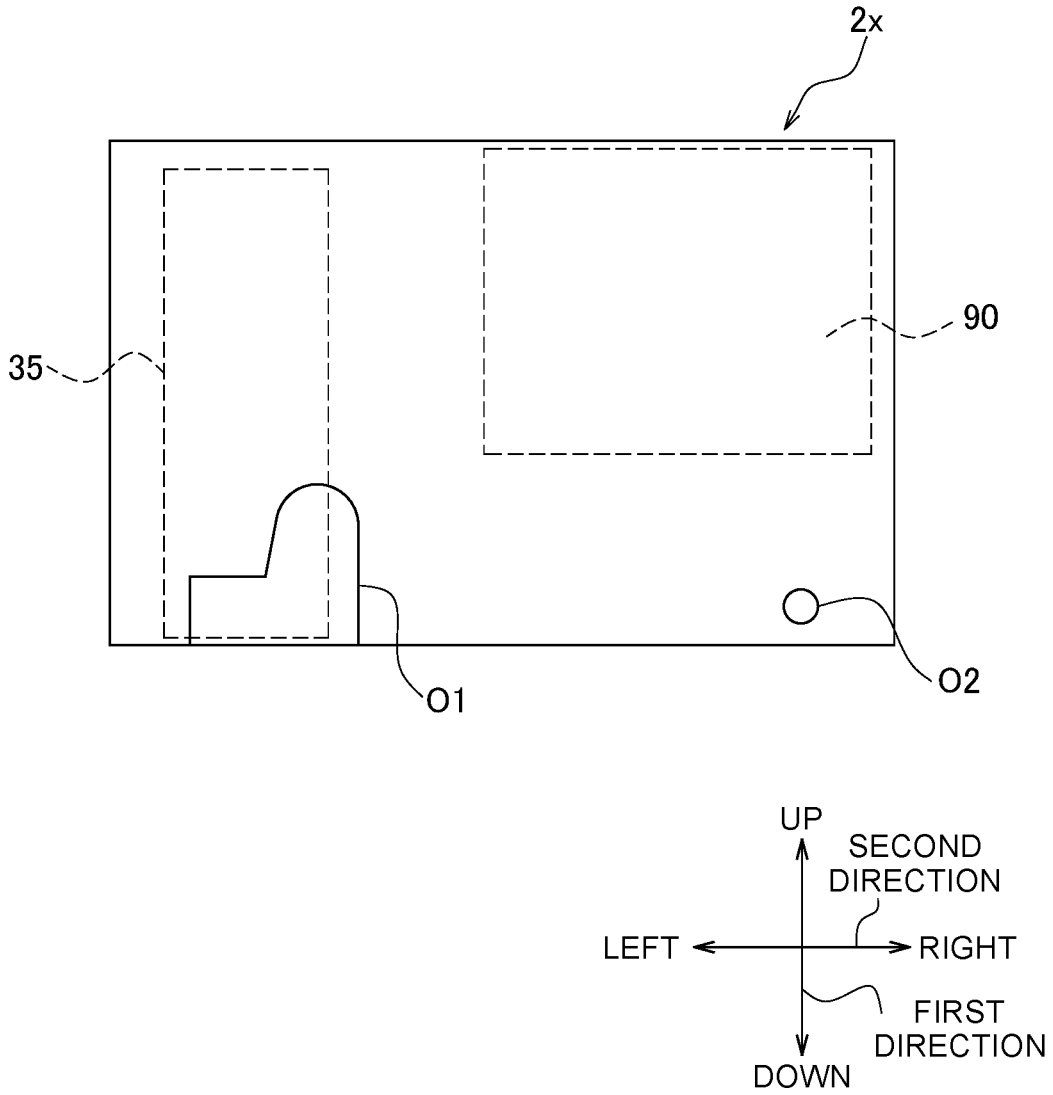
FIG. 10 is a schematic diagram of the cascade unit when viewed from a front.

The cascade heat exchanger 35 is disposed on the bottom plate constituting the bottom surface 120*f*. As shown in FIG. 10, when viewed from the front surface 120*a*, the electric component 90 and the cascade heat exchanger 35 do not overlap each other. In other words, the cascade heat exchanger 35 and the electric component 90 are disposed separately from each other in a longitudinal direction (second direction) of the front surface 120*a* as a side surface.

As shown in FIG. 9, the first pipe P1 and the second pipe P2 are disposed near the bottom surface 120*f*.

The front surface 120*a* extends in a first direction extending up and down and a second direction intersecting the first direction. Here, the front surface 120*a* extends in an up-down direction and a left-right direction orthogonal to the up-down direction. An opening O is formed in the front surface 120*a*. The opening O includes a pipe opening O1 and a wire opening O2.

The front surface 120*a* includes an upper plate 120*a*1, a lower plate 120*a*2, a first fixed plate 120*a*3, and a second fixed plate 120*a*4. The upper plate 120*a*1 and the lower plate 120*a*2 are detachable plate members. The upper plate 120*a*1 closes an opening for maintenance. The lower plate 120*a*2 is disposed below the upper plate 120*a*1. The first fixed plate 120*a*3 and the second fixed plate 120*a*4 are plate members fixed to the bottom plate constituting the bottom surface 120*f*.

The first fixed plate 120*a*3 has the pipe opening O1. The pipe opening O1 is an opening for leading out the first pipe P1 and the second pipe P2 in the first circuit 5*a* and the liquid pipe P3 and the gas pipes P4 and P5 in the second circuit 10. Therefore, the first pipe P1, the second pipe P2, the liquid pipe P3, and the gas pipes P4 and P5 pass through the pipe opening O1. Specifically, the first refrigerant pipe 113 or the first connection pipe 112, the second refrigerant pipe 114 or the second connection pipe 111, a liquid refrigerant pipe extending from the third connection pipe 7 or the cascade heat exchanger 35, a gas refrigerant pipe extending from the fourth connection pipe 8 or the cascade heat exchanger 35, and a gas refrigerant pipe extending from the fifth connection pipe 9 or the cascade heat exchanger 35 are located at the pipe opening O1. The cascade heat exchanger 35 is disposed near the pipe opening O1.

Figure 11:
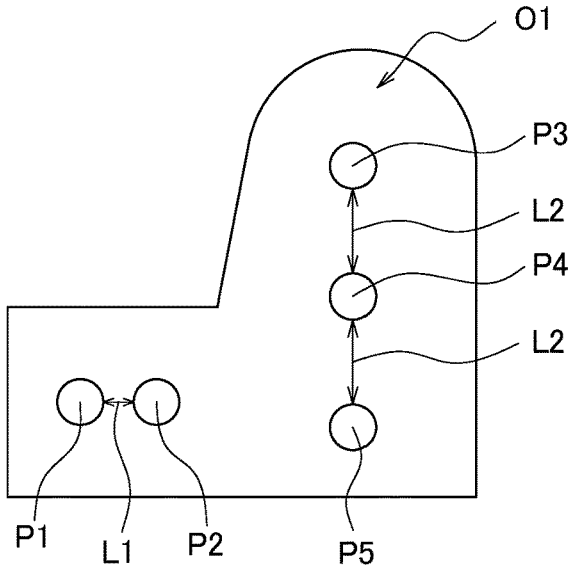
FIG. 11 is a schematic diagram of a pipe opening of the casing of the cascade unit.

The pipe opening O1 is a common opening at which the first pipe P1, the second pipe P2, the liquid pipe P3, and the gas pipes P4 and P5 are located. Here, in the pipe opening O1, the first pipe P1, the second pipe P2, the liquid pipe P3, and the gas pipes P4 and P5 are arranged in a plurality of different directions. In other words, the first pipe P1, the second pipe P2, the liquid pipe P3, and the gas pipes P4 and P5 are not arranged in one direction. In FIG. 11, the first pipe P1 and the second pipe P2 are arranged in the left-right direction, and the liquid pipe P3 and the gas pipes P4 and P5 are arranged in the up-down direction.

The second fixed plate 120*a*4 has the wire opening O2. The wire opening O2 is an opening for leading out a wire connected to the electric component 90. Therefore, the wire passes through the wire opening O2.

The pipe opening O1 is formed in a range from one end in the second direction (in FIG. 8, a left end in the left-right direction) to one third of a width in the second direction on the front surface 120*a*. The wire opening O2 is formed in a range from the other end in the first direction (in FIG. 8, a right end in the left-right direction) to one third of a width in the first direction on the front surface 120*a*.

The first direction (left-right direction) of the front surface 120*a* in which the pipe opening O1 and the wire opening O2 are formed is the longitudinal direction of the front surface 120*a*.

(5-2-2) First Connecting Portion and Second Connecting Portion

The cascade unit 2 includes the first connecting portion C1 and the second connecting portion C2 described above. The first connecting portion C1 and the second connecting portion C2 are located near the cascade casing 2*x* inside or outside the cascade casing 2*x*.

The first connecting portion C1 is a portion of the first pipe P1 and the second pipe P2 extending from the cascade heat exchanger 35, the portion being connected to the first pipe P1 and the second pipe P2 extending from the first heat exchanger 74. In FIG. 9, the first connecting portion C1 is an end of the first refrigerant pipe 113 and an end of the second refrigerant pipe 114, the ends being left without further treatment after being cut.

The second connecting portion C2 is a portion of the liquid pipe P3 and the gas pipes P4 and P5 extending from the cascade heat exchanger 35, the portion being connected to the liquid pipe P3 and the gas pipes P4 and P5 extending from the second heat exchangers 52*a*, 52*b*, and 52*c*. In FIG. 9, the second connecting portion C2 is the fifth shutoff valve 31 (C21), the third shutoff valve 32 (C22), and the fourth shutoff valve 33 (C23) accommodated in the cascade casing 2*x*. Specifically, the fifth shutoff valve 31 is the second connecting portion C21 of the liquid pipe P3. The third shutoff valve 32 is the second connecting portion C22 of the first gas pipe P4. The fourth shutoff valve 33 is the second connecting portion C23 of the second gas pipe P5.

The first connecting portion C1 and the second connecting portion C2 are disposed close to each other. The closeness refers to a distance of 0.5 times or less and preferably one third or less of a width (length in the longitudinal direction) of the cascade casing 2*x*. Specifically, the first connecting portion C1 and the second connecting portion C2 are located within a range of a distance of 0.5 times or less the width of the front surface 120*a* in the left-right direction.

In the present embodiment, in the cascade casing 2*x*, portions (leading positions) through which the first pipe P1 and the second pipe P2 in the first circuit 5*a* and the liquid pipe P3 and the gas pipes P4 and P5 in the second circuit 10 pass are disposed close to each other. In other words, in the cascade casing 2*x*, the two pipes, namely, the first pipe P1 and the second pipe P2 in the first circuit 5*a* and the three pipes, namely, the liquid pipe P3 and the gas pipes P4 and P5 in the second circuit 10 are disposed close to each other. Here, as described above, the two pipes, namely, first pipe P1 and the second pipes P2 in the first circuit 5*a* and the three pipes, namely, the liquid pipe P3 and the gas pipes P4 and P5 in the second circuit 10 are collected in the pipe opening O1 which is one opening.

In one case, the first connecting portion C1 and the second connecting portion C2 are located inside the cascade casing 2*x*, and in the other case, outside the cascade casing 2*x*. Therefore, at a predetermined position (in the pipe opening O1 in FIG. 8) of the cascade casing 2*x*, in one case, the connection pipes 111 and 112 are located (the first connecting portion C1 is inside the cascade casing 2*x*), and in the other case, the first refrigerant pipe 113 and the second refrigerant pipe 114 are located (the first connecting portion C1 is outside the casing). At a predetermined position (in the pipe opening O1 in FIG. 8) of the cascade casing 2*x*, in one case, the connection pipes 7, 8, and 9 are located (the second connecting portion C2 is inside the cascade casing 2*x*), and in the other case, the liquid pipe P3 and the gas pipes P4 and P5 extending from the cascade heat exchanger 35 are located (the second connecting portion C2 is outside the cascade casing 2*x*).

The first connecting portion C1 and the second connecting portion C2 are located on one side (the left side in FIG. 8) with respect to the center of the front surface 120*a* in the left-right direction when viewed from the front surface 120*a*. As described above, in the present embodiment, the first connecting portion C1 and the second connecting portion C2 are located adjacent to the same side surface with respect to the center in the left-right direction of the cascade casing 2*x*.

The first connecting portion C1 and the second connecting portion C2 are located below the center in the up-down direction. Here, the first connecting portion C1 is located below the second connecting portion C2.

The liquid pipe P3 and the gas pipes P4 and P5 which encloses carbon dioxide are disposed at an interval between each other. Specifically, as shown in FIG. 9, a distance L2 between the second connecting portion C21 of the liquid pipe P3 and the second connecting portions C22 and C23 of the gas pipes P4 and P5 is larger than a distance L1 between the first connecting portion C11 of the first pipe P1 and the first connecting portion C12 of the second pipe P2. The distance L2 between the second connecting portion C21 of the liquid pipe P3 and the second connecting portions C22 and C23 of the gas pipes P4 and P5 is a distance from a gas pipe in a direction closer to the liquid pipe P3, of the first gas pipe P4 or the second gas pipe P5.

Here, the distance L2 between the second connecting portion C21 of the liquid pipe P3 and the second connecting portion C22 of the first gas pipe P4 is larger than the distance L1 between the first connecting portion C11 of the first pipe P1 and the first connecting portion C12 of the second pipe P2. The distance between the second connecting portion C21 of the liquid pipe P3 and the second connecting portion C23 of the second gas pipe P5 is larger than the distance L1 between the first connecting portion C11 of the first pipe P1 and the first connecting portion C12 of the second pipe P2. The distance L2 between the second connecting portion C22 of the first gas pipe P4 and the second connecting portion C23 of the second gas pipe P5 is larger than the distance L1 between the first connecting portion C11 of the first pipe P1 and the first connecting portion C12 of the second pipe P2.

Specifically, as shown in FIG. 11, at the pipe opening O1 of the cascade casing 2x, the distance L2 between the liquid pipe P3 and the first gas pipe P4 is larger than the distance L1 between the first pipe P1 and the first connecting portion C12 of the second pipe P2. At the pipe opening O1 of the cascade casing 2x, the distance L2 between the first gas pipe P4 and the second gas pipe P5 is larger than the distance L1 between the first pipe P1 and the first connecting portion C12 of the second pipe P2.

The distance L2 between the second connecting portion C21 of the liquid pipe P3 and the second connecting portion C22 of the first gas pipe P4 and the distance L2 between the second connecting portion C22 of the first gas pipe P4 and the second connecting portion C23 of the second gas pipe P5 may be different, but are the same in the present embodiment.

Figure 12:
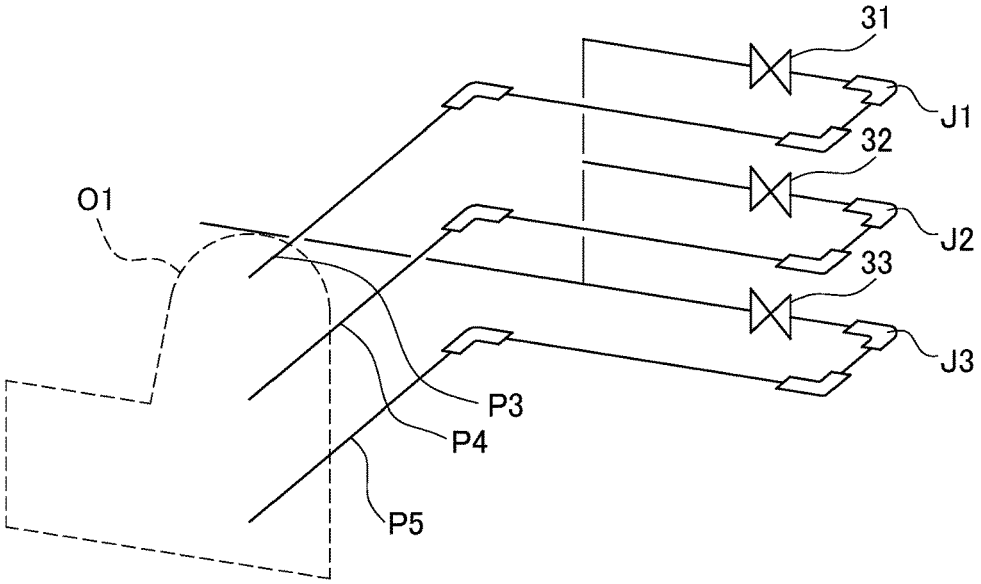
FIG. 12 is a schematic diagram of a liquid pipe and a gas pipe near a shutoff valve of the cascade unit.

As shown in FIG. 12, the liquid pipe P3 and the gas pipes P4 and P5 extending from the second heat exchangers 52a, 52b, and 52c are respectively connected to the third shutoff valve 32, the fourth shutoff valve 33, and the fifth shutoff valve 31 via joint members J1, J2, and J3. The joint members J1, J2, and J3 are, for example, bent pipes. The liquid pipe P3 and the gas pipes P4 and P5 are pipes extending linearly, and are connected to portions to be curved by using the joint members J1, J2, and J3.

The first connecting portion C1 is disposed near the bottom surface 120f. The first connecting portions C11 and C12 are fixed to the cascade casing 2x by a fixing member (not shown). Specifically, the fixing member fixes the first pipe P1 near the first connecting portion C11 to the bottom plate constituting the bottom surface 120f, and fixes the second pipe P2 near the first connecting portion C12 to the bottom plate constituting the bottom surface 120f. One fixing member may be provided, or a plurality of fixing members may be provided for every pipe.

The first pipe P1 and the second pipe P2, the liquid pipe P3, and the gas pipes P4 and P5 are disposed at positions higher than the bottom plate by 17 mm or more. When the bottom plate has an uneven shape, the positions of the first connecting portion C1 and the second connecting portion C2 (leading positions of the first pipe P1, the second pipe P2, the liquid pipe P3, and the gas pipes P4 and P5) are at a height of 17 mm or more from an upper surface of the bottom plate (an upper surface of a protrusion).

(5-2-3) Relationship Between Cascade Unit and First Unit

As shown in FIG. 7, in the present embodiment, the first unit 5 is disposed to a side of the cascade unit 2. Accordingly, the cascade unit 2 and the first unit 5 are disposed side by side on a rooftop of the building.

Here, the connection pipes 111 and 112 connecting the cascade unit 2 and the first unit 5 are led out along a horizontal direction from the pipe opening O1 of the cascade casing 2x. The connection pipes 7, 8, and 9 connecting the cascade unit 2 and the second units 4a, 4b, and 4c are also led out of the pipe opening O1 along the horizontal direction.

(6) Second Unit

The second units 4a, 4b, and 4c include the utilization units 3a, 3b, and 3c, the branch units 6a, 6b, and 6c, the first connecting tubes 15a, 15b, and 15c, and the second connecting tubes 16a, 16b, and 16c.

(6-1) Utilization Unit

The utilization units 3a, 3b, and 3c are installed by being embedded in or being suspended from a ceiling in an indoor space of an office building or the like, or by being hung on a wall surface in the indoor space, or the like.

The utilization units 3a, 3b, and 3c are connected to the cascade unit 2 via the connection pipes 7, 8, and 9.

The utilization units 3a, 3b, and 3c respectively include the utilization circuits 13a, 13b, and 13c constituting a part of the second circuit 10.

Hereinafter, configurations of the utilization units 3a, 3b, and 3c are described. The second utilization unit 3b and the third utilization unit 3c are configured similarly to the first utilization unit 3a. The configuration of only the first utilization unit 3a will thus be described here. As for the configuration of each of the second utilization unit 3b and the third utilization unit 3c, elements will be denoted by reference signs obtained by replacing a subscript "a" in reference signs of elements of the first utilization unit 3a with a subscript "b" or "c", and these elements will not be described repeatedly.

The first utilization unit 3a mainly includes the utilization circuit 13a described above, a second fan 53a, the utilization-side control unit 50a, and various sensors. The second fan 53a includes a second fan motor 54a.

The second fan 53a generates an air flow of sucking indoor air into the utilization unit 3a and supplying the indoor space with supply air obtained after heat exchange with the refrigerant flowing in the second heat exchanger 52a. The second fan 53a is driven by the second fan motor 54a.

The utilization unit 3a is provided with a liquid-side temperature sensor 58a that detects a temperature of a refrigerant on the liquid side of the second heat exchanger 52a. In addition, the utilization unit 3a is provided with an indoor temperature sensor 55a that detects an indoor temperature that is the temperature of the air introduced from the indoor space before passing through the second heat exchanger 52a.

The utilization-side control unit 50a controls behavior of the members 51a and 53a (54a) of the utilization unit 3a. Furthermore, the utilization-side control unit 50a includes a processor such as a CPU and a microcomputer, and a memory, which are provided for controlling the utilization unit 3a, and can exchange control signals and the like with a remote controller (not shown), and exchange control signals and the like with the heat source-side control unit 20 and the branch unit control units 60a, 60b, and 60c of the cascade unit 2, and with the first control unit 70 of the first unit 5.

Note that the second utilization unit 3b includes the utilization circuit 13b, a second fan 53b, the utilization-side control unit 50b, and a second fan motor 54b. The third utilization unit 3c includes the utilization circuit 13c, a second fan 53c, the utilization-side control unit 50c, and a second fan motor 54c.

(6-2) Branch Unit

The branch units 6a, 6b, and 6c are installed in a space behind the ceiling of the indoor space of an office building or the like.

Each of the branch units 6a, 6b, and 6c is connected to a corresponding one of the utilization units 3a, 3b, and 3c on one-on-one basis. The branch units 6a, 6b, and 6c are connected to the cascade unit 2 via the connection pipes 7, 8, and 9.

Next, configurations of the branch units 6a, 6b, and 6c will be described. The second branch unit 6b and the third branch unit 6c are configured similarly to the first branch unit 6*a*. The configuration of only the first branch unit 6*a* will thus be described here. As for the configuration of each of the second branch unit 6*b* and the third branch unit 6*c*, elements will be denoted by reference signs obtained by replacing a subscript "a" in reference signs of elements of the first branch unit 6*a* with a subscript "b" or "c", and these elements will not be described repeatedly.

The first branch unit 6*a* mainly includes the branch circuit 14*a* and the branch unit control unit 60*a* described above.

The branch unit control unit 60*a* controls behavior of the members 66*a* and 67*a* constituting the branch unit 6*a*. The branch unit control unit 60*a* includes a processor, such as a CPU or a microcomputer, and a memory provided to control the branch unit 6*a*, and can exchange control signals and the like with a remote controller (not shown) and exchange control signals and the like with the heat source-side control unit 20 and the utilization units 3*a*, 3*b*, and 3*c* of the cascade unit 2 and with the first control unit 70 of the first unit 5.

Note that the second branch unit 6*b* includes the branch circuit 14*b* and the branch unit control unit 60*b*. The third branch unit 6*c* includes the branch circuit 14*c* and the branch unit control unit 60*c*.

(7) Control Unit

In the refrigeration system 1, the heat source-side control unit 20, the utilization-side control units 50*a*, 50*b*, and 50*c*, the branch unit control units 60*a*, 60*b*, and 60*c*, and the first control unit 70 described above are communicably connected to each other in a wired or wireless manner to constitute a control unit 80. The control unit 80 accordingly controls behavior of the members 21 (21*a*), 22, 36, 44, 46*a*, 48*a*, 51*a*, 51*b*, 51*c*, 53*a*, 53*b*, 53*c* (54*a*, 54*b*, 54*c*), 66*a*, 66*b*, 66*c*, 67*a*, 67*b*, 67*c*, 71 (71*a*), 72, 75 (75*a*), 76, 104*a*, and the like in accordance with detection information of the various sensors 37, 38, 39, 83, 84, 85, 86, 87, 88, 77, 78, 79, 81, 82, 58*a*, 58*b*, 58*c*, and the like, command information received from the remote controller (not shown), and the like.

(8) Behavior of Refrigeration System

Next, the behavior of the refrigeration system 1 is described with reference to FIGS. 3 to 6.

The refrigeration cycle operation of the refrigeration system 1 can be mainly divided into the cooling operation, the heating operation, the cooling main operation, and the heating main operation.

Here, the cooling operation is refrigeration cycle operation in which only the utilization unit in which the second heat exchangers 52*a*, 52*b*, and 52*c* function as evaporators for the second refrigerant exists, and the cascade heat exchanger 35 functions as a radiator for the second refrigerant for an evaporation load of the entire utilization unit.

Here, the heating operation is refrigeration cycle operation in which only the utilization unit in which the second heat exchangers 52*a*, 52*b*, and 52*c* function as radiators for the second refrigerant exists, and the cascade heat exchanger 35 functions as an evaporator for the second refrigerant for a radiation load of the entire utilization unit.

The cooling main operation is operation in which the utilization unit in which the second heat exchangers 52*a*, 52*b*, and 52*c* function as evaporators for the second refrigerant and the utilization unit in which the second heat exchangers 52*a*, 52*b*, and 52*c* function as radiators for the refrigerant are mixed. The cooling main operation is refrigeration cycle operation in which, when an evaporation load is a main thermal load of the entire utilization unit, the cascade heat exchanger 35 functions as a radiator for the second refrigerant in order to process the evaporation load of the entire utilization unit.

The heating main operation is operation in which the utilization unit in which the second heat exchangers 52*a*, 52*b*, and 52*c* function as evaporators for the refrigerant and the utilization unit in which the second heat exchangers 52*a*, 52*b*, and 52*c* function as radiators for the refrigerant are mixed. The heating main operation is refrigeration cycle operation in which, when a radiation load is a main heat load of the entire utilization unit, the cascade heat exchanger 35 functions as an evaporator for the second refrigerant in order to process the radiation load of the entire utilization unit.

The behavior of the refrigeration system 1 including these refrigeration cycle operations is executed by the control unit 80.

(8-1) Cooling Operation

Figure 3:
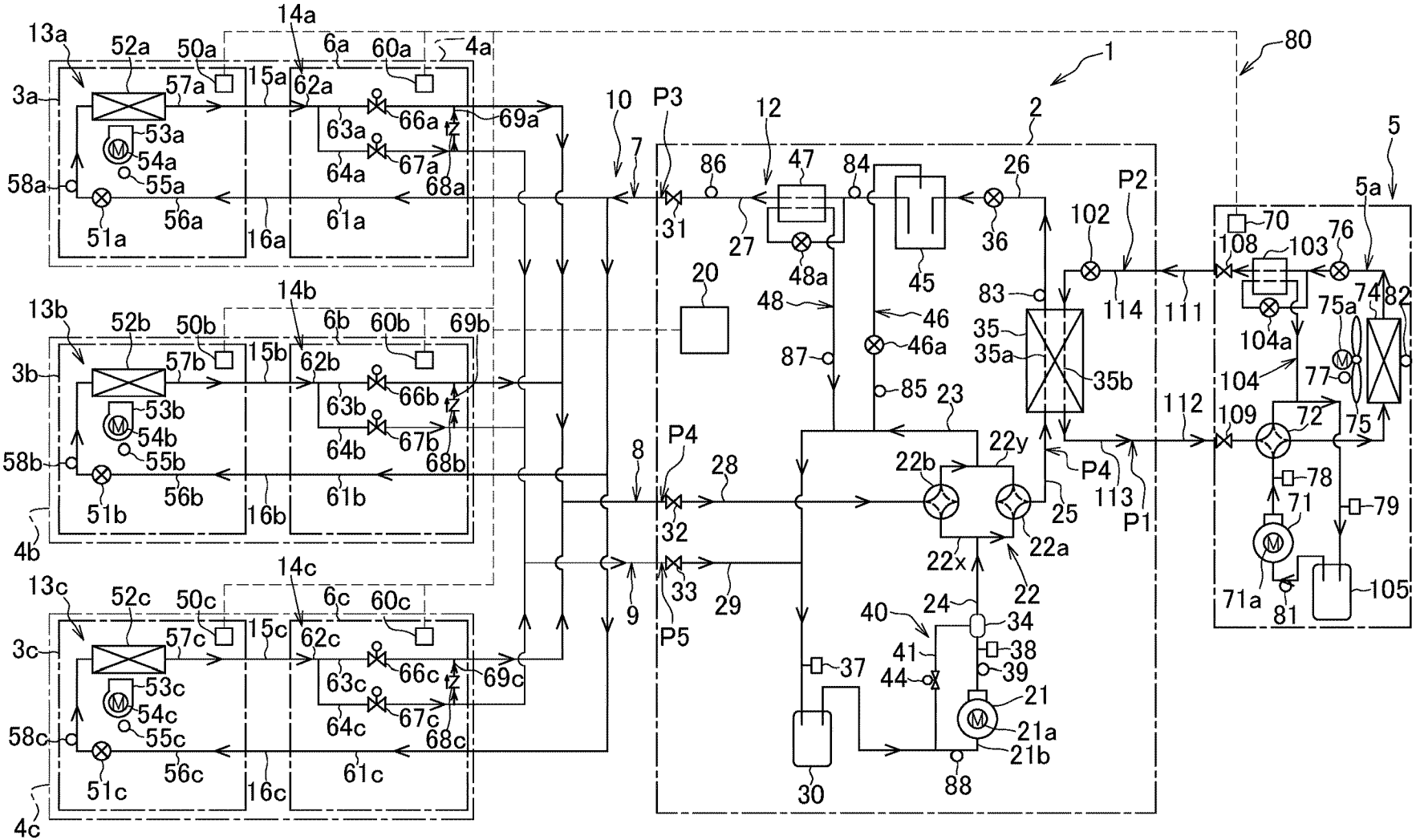
FIG. 3 is a diagram illustrating behavior (flows of a refrigerant) in a cooling operation of the refrigeration system.

In the cooling operation, for example, each of the second heat exchangers 52*a*, 52*b*, and 52*c* in the utilization units 3*a*, 3*b*, and 3*c* functions as a refrigerant evaporator, and the cascade heat exchanger 35 functions as a radiator for the second refrigerant. In the cooling operation, the first circuit 5*a* and the second circuit 10 of the refrigeration system 1 are configured as shown in FIG. 3. Note that arrows attached to the first circuit 5*a* and arrows attached to the second circuit 10 in FIG. 3 indicate flows of the refrigerant during the cooling operation.

Specifically, in the first unit 5, the first switching mechanism 72 is switched to the fifth connecting state to cause the cascade heat exchanger 35 to function as an evaporator for the first refrigerant. The fifth connecting state of the first switching mechanism 72 is depicted by the solid lines in the first switching mechanism 72 in FIG. 3. Accordingly, in the first unit 5, the first refrigerant discharged from the first compressor 71 passes through the first switching mechanism 72 and exchanges heat with outdoor air supplied from the first fan 75 in the first heat exchanger 74 to be condensed. The first refrigerant condensed in the first heat exchanger 74 passes the first expansion valve 76 controlled into a fully opened state, and a part of the refrigerant flows toward the second shutoff valve 108 via the first subcooling heat exchanger 103, and another part of the refrigerant branches into the first subcooling circuit 104. The refrigerant flowing in the first subcooling circuit 104 is decompressed while passing through the first subcooling expansion valve 104*a*. The refrigerant flowing from the first expansion valve 76 toward the second shutoff valve 108 exchanges heat with the refrigerant decompressed by the first subcooling expansion valve 104*a* and flowing in the first subcooling circuit 104 in the first subcooling heat exchanger 103, and is cooled until reaching a subcooled state. The refrigerant in the subcooled state passes through the second connection pipe 111, and the first refrigerant is decompressed when passing through second expansion valve 102. Here, the valve opening degree of the second expansion valve 102 is controlled such that a degree of superheating of the first refrigerant sucked into the first compressor 71 satisfies a predetermined condition. When flowing through the first flow path 35*b* of the cascade heat exchanger 35, the first refrigerant decompressed by the second expansion valve 102 evaporates by exchanging heat with the second refrigerant flowing through the second flow path 35*a*, and flows toward the first connection pipe 112. The first refrigerant passes through the first connection pipe 112 and the first shutoff valve 109, and then reaches the first switching mechanism 72. The refrigerant having passed through the first switching mechanism 72 joins the refrigerant having flowed in the first subcooling circuit 104, and is then sucked into the first compressor 71 via the first accumulator 105.

In the cascade unit 2, by switching the second switching mechanism 22 to the first connecting state, the cascade heat exchanger 35 functions as a radiator for the second refrigerant. Note that, in the first connecting state of the second switching mechanism 22, the discharge flow path 24 and the third heat source pipe 25 are connected by the first switching valve 22*a*, and the first heat source pipe 28 and the suction flow path 23 are connected by the second switching valve 22*b*. Here, the opening degree of the heat source-side expansion valve 36 is adjusted. In the first to third utilization units 3*a*, 3*b*, and 3*c*, the second control valves 67*a*, 67*b*, and 67*c* are controlled into the opened state. Accordingly, each of the second heat exchangers 52*a*, 52*b*, and 52*c* in the utilization units 3*a*, 3*b*, and 3*c* functions as a refrigerant evaporator. All of the second heat exchangers 52*a*, 52*b*, and 52*c* of the utilization units 3*a*, 3*b*, and 3*c* and the suction side of the second compressor 21 of the cascade unit 2 are connected via the first utilization pipes 57*a*, 57*b*, and 57*c*, the first connecting tubes 15*a*, 15*b*, and 15*c*, the junction pipes 62*a*, 62*b*, and 62*c*, the second branch pipes 64*a*, 64*b*, and 64*c*, the bypass pipes 69*a*, 69*b*, and 69*c*, some of the first branch pipes 63*a*, 63*b*, and 63*c*, the fourth connection pipe 8, and the fifth connection pipe 9. The opening degree of the second subcooling expansion valve 48*a* is controlled such that a degree of subcooling of the second refrigerant flowing through the outlet of the second subcooling heat exchanger 47 toward the third connection pipe 7 satisfies a predetermined condition. The bypass expansion valve 46*a* is controlled into the closed state. In the utilization units 3*a*, 3*b*, and 3*c*, the opening degrees of the utilization-side expansion valves 51*a*, 51*b*, and 51*c* are adjusted.

In such a second circuit 10, the high-pressure second refrigerant compressed and discharged by the second compressor 21 is sent to the second flow path 35*a* of the cascade heat exchanger 35 through the first switching valve 22*a* of the second switching mechanism 22. The high-pressure second refrigerant flowing in the second flow path 35*a* of the cascade heat exchanger 35 radiates heat, and the first refrigerant flowing in the first flow path 35*b* of the cascade heat exchanger 35 evaporates. The second refrigerant having radiated heat in the cascade heat exchanger 35 passes through the heat source-side expansion valve 36 whose opening degree is adjusted, and then flows into the second receiver 45. A part of the second refrigerant having flowed out of the second receiver 45 is branched into the second subcooling circuit 48, is decompressed at the second subcooling expansion valve 48*a*, and then joins the suction flow path 23. In the second subcooling heat exchanger 47, another part of the remaining refrigerant having flowed out of the second receiver 45 is cooled by the refrigerant flowing in the second subcooling circuit 48, and is then sent to the third connection pipe 7 via the fifth shutoff valve 31.

The refrigerant sent to the third connection pipe 7 is branched into three portions to pass through the third branch pipes 61*a*, 61*b*, and 61*c* of the first to third branch units 6*a*, 6*b*, and 6*c*. Thereafter, the refrigerant having flowed through the second connecting tubes 16*a*, 16*b*, and 16*c* is sent to the second utilization pipes 56*a*, 56*b*, and 56*c* of the first to third utilization units 3*a*, 3*b*, and 3*c*. The refrigerant sent to the second utilization pipes 56*a*, 56*b*, and 56*c* is sent to the utilization-side expansion valves 51*a*, 51*b*, and 51*c* in the utilization units 3*a*, 3*b*, and 3*c*.

Then, the second refrigerant having passed the utilization-side expansion valves 51*a*, 51*b*, and 51*c* whose opening degrees are adjusted exchanges heat with indoor air supplied by the second fans 53*a*, 53*b*, and 53*c* in the second heat exchangers 52*a*, 52*b*, and 52*c*. The second refrigerant flowing in the second heat exchangers 52*a*, 52*b*, and 52*c* is thus evaporated into a low-pressure gas refrigerant. Indoor air is cooled and is supplied into the indoor space. The indoor space is thus cooled. The low-pressure gas refrigerant evaporated in the second heat exchangers 52*a*, 52*b*, and 52*c* flows through the first utilization pipes 57*a*, 57*b*, and 57*c*, flows through the first connecting tubes 15*a*, 15*b*, and 15*c*, and then is sent to the junction pipes 62*a*, 62*b*, and 62*c* of the first to third branch units 6*a*, 6*b*, and 6*c*.

Then, the low-pressure gas refrigerant sent to the junction pipes 62*a*, 62*b*, and 62*c* flows to the second branch pipes 64*a*, 64*b*, and 64*c*. A part of the second refrigerant that has passed through the second control valves 67*a*, 67*b*, and 67*c* in the second branch pipes 64*a*, 64*b*, and 64*c* is sent to the fifth connection pipe 9. A remaining part of the refrigerant that has passed through the second control valves 67*a*, 67*b*, and 67*c* passes through the bypass pipes 69*a*, 69*b*, and 69*c*, flows through a part of the first branch pipes 63*a*, 63*b*, and 63*c*, and then is sent to the fourth connection pipe 8.

The low-pressure gas refrigerant sent to the fourth connection pipe 8 and the fifth connection pipe 9 is returned to the suction side of the second compressor 21 via the third shutoff valve 32, the fourth shutoff valve 33, the first heat source pipe 28, the second heat source pipe 29, the second switching valve 22*b* of the second switching mechanism 22, the suction flow path 23, and the second accumulator 30.

In the cooling operation, the second circuit 10 controls capacity, for example, by controlling the second compressor 21 so that evaporation temperature of the second refrigerant in the second heat exchangers 52*a*, 52*b*, and 52*c* becomes predetermined evaporation target temperature. Then, the first circuit 5*a* controls capacity, for example, by controlling the first compressor 71 such that evaporation temperature of the first refrigerant in the first flow path 35*b* of the cascade heat exchanger 35 becomes predetermined evaporation target temperature. Here, the evaporation target temperature is changed such that a carbon dioxide refrigerant flowing through the second flow path 35*a* of the cascade heat exchanger 35 does not exceed a critical point when an operation condition is not a predetermined operation condition in which the carbon dioxide refrigerant exceeds the critical point. Also, the evaporation target temperature is changed such that the carbon dioxide refrigerant exceeds the critical point by more than a predetermined amount when the operation condition is the predetermined operation condition in which the carbon dioxide refrigerant exceeds the critical point.

Behavior during the cooling operation is executed in this manner.

(8-2) Heating Operation

Figure 4:
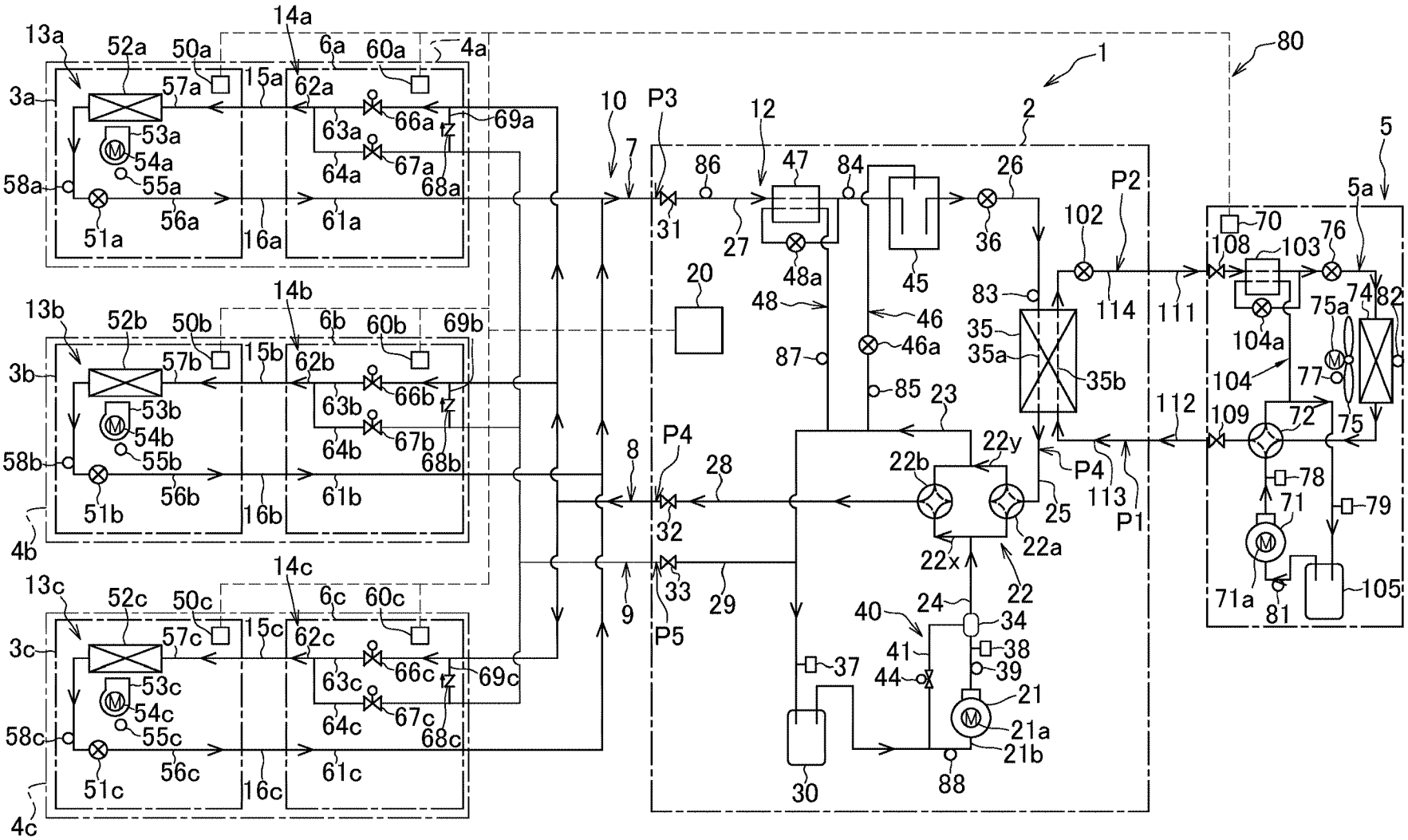
FIG. 4 is a diagram illustrating behavior (flows of the refrigerant) in a heating operation of the refrigeration system.

In the heating operation, for example, each of the second heat exchangers 52*a*, 52*b*, and 52*c* in the utilization units 3*a*, 3*b*, and 3*c* functions as a refrigerant radiator. In the heating operation, the cascade heat exchanger 35 operates to function as an evaporator for the second refrigerant. In the heating operation, the first circuit 5*a* and the second circuit 10 of the refrigeration system 1 are configured as shown in FIG. 4. Arrows attached to the first circuit 5*a* and arrows attached to the second circuit 10 in FIG. 4 indicate flows of the refrigerant during the heating operation.

Specifically, in the first unit 5, the first switching mechanism 72 is switched to a sixth operating state to cause the cascade heat exchanger 35 to function as a radiator for the first refrigerant. The sixth operating state of the first switching mechanism 72 corresponds to a connecting state depicted by broken lines in the first switching mechanism 72 in FIG. 4. Accordingly, in the first unit 5, the first refrigerant discharged from the first compressor 71 and passing through the first switching mechanism 72 further passes through the first connection pipe 112, and is sent to the first flow path 35*b* of the cascade heat exchanger 35. The refrigerant flowing in the first flow path 35*b* of the cascade heat exchanger 35 exchanges heat with the second refrigerant flowing in the second flow path 35*a* to be condensed. When flowing through the second refrigerant pipe 114, the first refrigerant condensed in the cascade heat exchanger 35 passes through the second expansion valve 102 controlled into the fully opened state. The refrigerant that has passed through the second expansion valve 102 flows through the second connection pipe 111, the second liquid shutoff valve 108, and the first subcooling heat exchanger 103 in that order, and is decompressed at the first expansion valve 76. During the heating operation, the first subcooling expansion valve 104*a* is controlled into the closed state, so that the refrigerant does not flow into the first subcooling circuit 104. Therefore, no heat is exchanged in the first subcooling heat exchanger 103. The valve opening degree of the first expansion valve 76 is controlled such that, for example, a degree of superheating of the first refrigerant sucked into the first compressor 71 satisfies a predetermined condition. The refrigerant decompressed at the first expansion valve 76 exchanges heat with outdoor air supplied from the first fan 75 in the first heat exchanger 74 to be evaporated, and is sucked into the first compressor 71 via the first switching mechanism 72 and the first accumulator 105.

In the cascade unit 2, the second switching mechanism 22 is switched to the second connecting state. The cascade heat exchanger 35 thus functions as an evaporator for the second refrigerant. In the second connecting state of the second switching mechanism 22, the discharge flow path 24 and the first heat source pipe 28 are connected by the second switching valve 22*b*, and the third heat source pipe 25 and the suction flow path 23 are connected by the first switching valve 22*a*. The opening degree of the heat source-side expansion valve 36 is adjusted. In the first to third branch units 6*a*, 6*b*, and 6*c*, the first control valves 66*a*, 66*b*, and 66*c* are controlled into the opened state, and the second control valves 67*a*, 67*b*, and 67*c* are controlled into the closed state. Accordingly, each of the second heat exchangers 52*a*, 52*b*, and 52*c* in the utilization units 3*a*, 3*b*, and 3*c* functions as a refrigerant radiator. The second heat exchangers 52*a*, 52*b*, and 52*c* in the utilization units 3*a*, 3*b*, and 3*c* and the discharge side of the second compressor 21 in the cascade unit 2 are connected via the discharge flow path 24, the first heat source pipe 28, the fourth connection pipe 8, the first branch pipes 63*a*, 63*b*, and 63*c*, the junction pipes 62*a*, 62*b*, and 62*c*, the first connecting tubes 15*a*, 15*b*, and 15*c*, and the first utilization pipes 57*a*, 57*b*, and 57*c*. The second subcooling expansion valve 48*a* and the bypass expansion valve 46*a* are controlled into the closed state. In the utilization units 3*a*, 3*b*, and 3*c*, the opening degrees of the utilization-side expansion valves 51*a*, 51*b*, and 51*c* are adjusted.

In such a second circuit 10, the high-pressure refrigerant compressed and discharged by the second compressor 21 is sent to the first heat source pipe 28 through the second switching valve 22*b* of the second switching mechanism 22. The refrigerant sent to the first heat source pipe 28 is sent to the fourth connection pipe 8 via the third shutoff valve 32.

The high-pressure refrigerant sent to the fourth connection pipe 8 is branched into three portions to be sent to the first branch pipes 63*a*, 63*b*, and 63*c* in each of the utilization units 3*a*, 3*b*, and 3*c* in operation. The high-pressure second refrigerant sent to the first branch pipes 63*a*, 63*b*, and 63*c* passes through the first control valves 66*a*, 66*b*, and 66*c*, and flows in the junction pipes 62*a*, 62*b*, and 62*c*. The refrigerant having flowed in the first connecting tubes 15*a*, 15*b*, and 15*c* and the first utilization pipes 57*a*, 57*b*, and 57*c* is then sent to the second heat exchangers 52*a*, 52*b*, and 52*c*.

Then, the high-pressure second refrigerant sent to the second heat exchangers 52*a*, 52*b*, and 52*c* exchanges heat with indoor air supplied by the second fans 53*a*, 53*b*, and 53*c* in the second exchangers 52*a*, 52*b*, and 52*c*. The second refrigerant flowing in the second heat exchangers 52*a*, 52*b*, and 52*c* thus radiates heat. Indoor air is heated and is supplied into the indoor space. The indoor space is thus heated. The second refrigerant having radiated heat in the second heat exchangers 52*a*, 52*b*, and 52*c* flows in the second utilization pipes 56*a*, 56*b*, and 56*c* and passes the utilization-side expansion valves 51*a*, 51*b*, and 51*c* whose opening degrees are adjusted. Thereafter, the refrigerant having flowed through the second connecting tubes 16*a*, 16*b*, and 16*c* flows in the third branch pipes 61*a*, 61*b*, and 61*c* of the branch units 6*a*, 6*b*, and 6*c*.

The second refrigerant sent to the third branch pipes 61*a*, 61*b*, and 61*c* is sent to the third connection pipe 7 to join.

The second refrigerant sent to the third connection pipe 7 is sent to the heat source-side expansion valve 36 via the fifth shutoff valve 31. The flow rate of the refrigerant sent to the heat source-side expansion valve 36 is adjusted by the heat source-side expansion valve 36, and then the refrigerant is sent to the cascade heat exchanger 35. In the cascade heat exchanger 35, the second refrigerant flowing in the second flow path 35*a* is evaporated into a low-pressure gas refrigerant and is sent to the second switching mechanism 22, and the first refrigerant flowing in the first flow path 35*b* of the cascade heat exchanger 35 is condensed. Then, the low-pressure gas refrigerant sent to the first switching valve 22*a* of the second switching mechanism 22 is returned to the suction side of the second compressor 21 through the suction flow path 23 and the second accumulator 30.

Note that, in this heating operation, the second circuit 10 controls capacity, for example, by controlling the second compressor 21 so as to process loads in the second heat exchanger 52*a*, 52*b*, and 52*c*. Then, the first circuit 5*a* controls capacity, for example, by controlling the first compressor 71 such that condensation temperature of the first refrigerant in the first flow path 35*b* of the cascade heat exchanger 35 becomes predetermined condensation target temperature.

Behavior during the heating operation is executed in this manner.

(8-3) Cooling Main Operation

Figure 5:
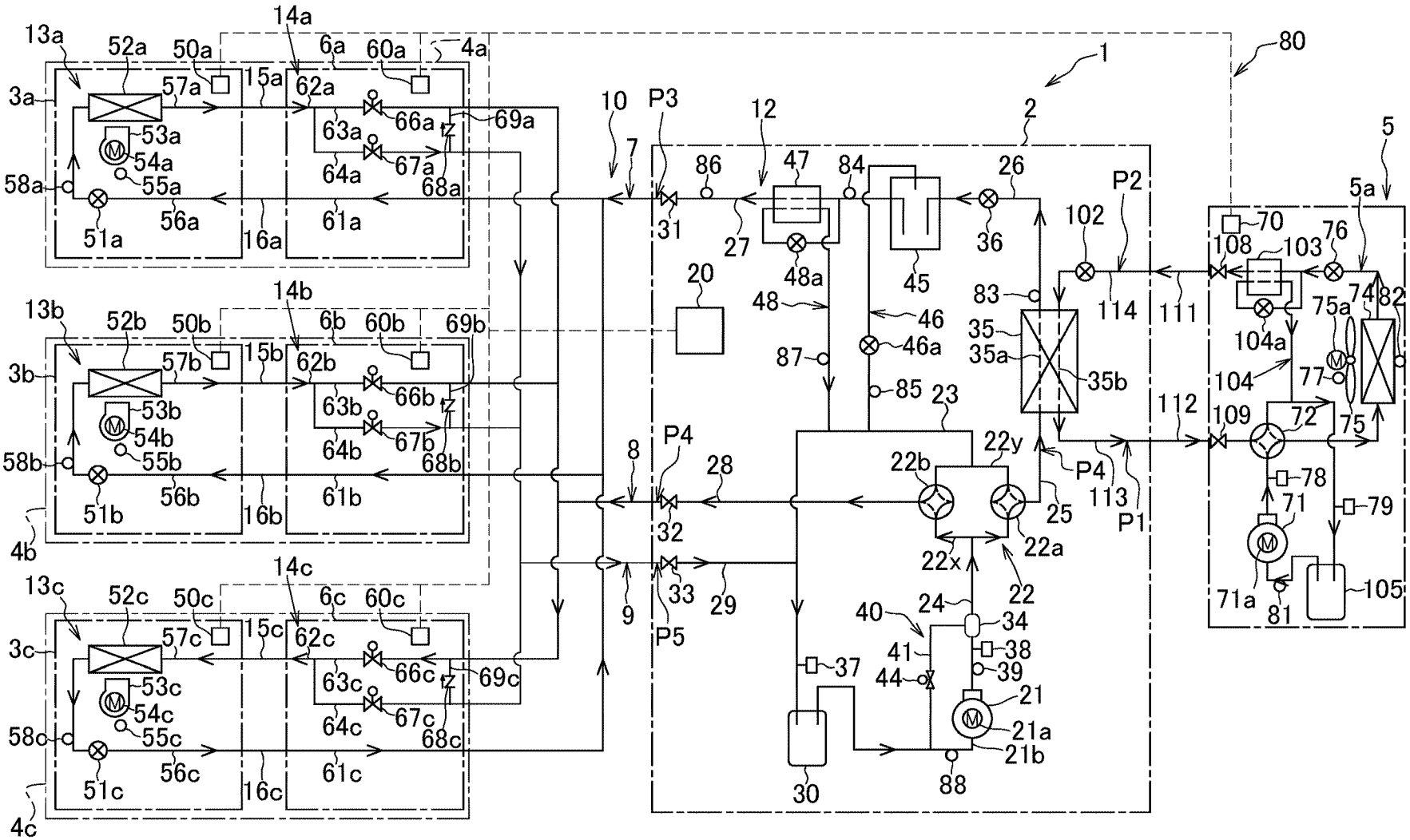
FIG. 5 is a diagram illustrating behavior (flows of the refrigerant) in a simultaneous cooling and heating operation (cooling main operation) of the refrigeration system.

In the cooling main operation, for example, the second heat exchangers 52*a* and 52*b* in the utilization units 3*a* and 3*b* each function as a refrigerant evaporator, and the second heat exchanger 52*c* in the utilization unit 3*c* functions as a refrigerant radiator. In the cooling main operation, the cascade heat exchanger 35 functions as a radiator for the second refrigerant. In the cooling main operation, the first circuit 5*a* and the second circuit 10 of the refrigeration system 1 are configured as shown in FIG. 5. Arrows attached to the first circuit 5*a* and arrows attached to the second circuit 10 in FIG. 5 indicate flows of the refrigerant during the cooling main operation.

Specifically, in the first unit 5, the first switching mechanism 72 is switched to the fifth connecting state (the state depicted by solid lines in the first switching mechanism 72 in FIG. 5) to cause the cascade heat exchanger 35 to function as an evaporator for the first refrigerant. Accordingly, in the first unit 5, the first refrigerant discharged from the first compressor 71 passes through the first switching mechanism 72 and exchanges heat with outdoor air supplied from the first fan 75 in the first heat exchanger 74 to be condensed. The first refrigerant condensed in the first heat exchanger 74 passes the first expansion valve 76 controlled into a fully opened state, and a part of the refrigerant flows toward the second shutoff valve 108 via the first subcooling heat exchanger 103, and another part of the refrigerant branches into the first subcooling circuit 104. The refrigerant flowing in the first subcooling circuit 104 is decompressed while passing through the first subcooling expansion valve 104*a*. The refrigerant flowing from the first expansion valve 76 toward the second shutoff valve 108 exchanges heat with the refrigerant decompressed by the first subcooling expansion valve 104*a* and flowing in the first subcooling circuit 104 in the first subcooling heat exchanger 103, and is cooled until reaching a subcooled state. The refrigerant in the subcooled state flows in the second connection pipe 111 and is decompressed at the second expansion valve 102. At this time, the valve opening degree of the second expansion valve 102 is controlled such that, for example, a degree of superheating of the refrigerant sucked into the first compressor 71 satisfies a predetermined condition. When flowing through the first flow path 35*b* of the cascade heat exchanger 35, the first refrigerant decompressed by the second expansion valve 102 evaporates by exchanging heat with the second refrigerant flowing through the second flow path 35*a*, and flows toward the first connection pipe 112. The first refrigerant passes through the first connection pipe 112 and the first shutoff valve 109, and then reaches the first switching mechanism 72. The refrigerant having passed through the first switching mechanism 72 joins the refrigerant having flowed in the first subcooling circuit 104, and is then sucked into the first compressor 71 via the first accumulator 105.

In the cascade unit 2, the second switching mechanism 22 is switched to the third connecting state in which the discharge flow path 24 and the third heat source pipe 25 are connected by the first switching valve 22*a* and the discharge flow path 24 and the first heat source pipe 28 are connected by the second switching valve 22*b* to cause the cascade heat exchanger 35 to function as a radiator for the second refrigerant. The opening degree of the heat source-side expansion valve 36 is adjusted. In the first to third branch units 6*a*, 6*b*, and 6*c*, the first control valve 66*c* and the second control valves 67*a* and 67*b* are controlled into the opened state, and the first control valves 66*a* and 66*b* and the second control valve 67*c* are controlled into the closed state. Accordingly, the second heat exchangers 52*a* and 52*b* in the utilization units 3*a* and 3*b* each function as a refrigerant evaporator, and the second heat exchanger 52*c* in the utilization unit 3*c* functions as a refrigerant radiator. The second heat exchangers 52*a* and 52*b* in the utilization units 3*a* and 3*b* and the suction side of the second compressor 21 in the cascade unit 2 are connected via the fifth connection pipe 9, and the second heat exchanger 52*c* in the utilization unit 3*c* and the discharge side of the second compressor 21 in the cascade unit 2 are connected via the fourth connection pipe 8. The opening degree of the second subcooling expansion valve 48*a* is controlled such that a degree of subcooling of the second refrigerant flowing through the outlet of the second subcooling heat exchanger 47 toward the third connection pipe 7 satisfies a predetermined condition. The bypass expansion valve 46*a* is controlled into the closed state. In the utilization units 3*a*, 3*b*, and 3*c*, the opening degrees of the utilization-side expansion valves 51*a*, 51*b*, and 51*c* are adjusted.

In such a second circuit 10, a part of the high-pressure second refrigerant compressed and discharged by the second compressor 21 is sent to the fourth connection pipe 8 through the second switching valve 22*b* of the second switching mechanism 22, the first heat source pipe 28, and the third shutoff valve 32, and the remaining refrigerant is sent to the second flow path 35*a* of the cascade heat exchanger 35 through the first switching valve 22*a* of the second switching mechanism 22 and the third heat source pipe 25.

The high-pressure refrigerant sent to the fourth connection pipe 8 is sent to the first branch pipe 63*c*. The high-pressure refrigerant sent to the first branch pipe 63*c* is sent to the second heat exchanger 52*c* in the utilization unit 3*c* via the first control valve 66*c* and the junction pipe 62*c*.

Then, the high-pressure refrigerant sent to the second heat exchanger 52*c* exchanges heat with indoor air supplied by the second fan 53*c* in the second heat exchanger 52*c*. The second refrigerant flowing in the second heat exchanger 52*c* thus radiates heat. Indoor air is heated and is supplied into the indoor space, and the utilization unit 3*c* executes heating operation. The second refrigerant having radiated heat in the second heat exchanger 52*c* flows in the second utilization pipe 56*c*, and the flow rate of the refrigerant is adjusted at the utilization-side expansion valve 51*c*. The second refrigerant having flowed through the second connecting tube 16*c* is sent to the third branch pipe 61*c* in the branch unit 6*c*.

The second refrigerant sent to the third branch pipe 61*c* is sent to the third connection pipe 7.

The high-pressure refrigerant sent to the second flow path 35*a* of the cascade heat exchanger 35 exchanges heat with the first refrigerant flowing in the first flow path 35*b* in the cascade heat exchanger 35 to radiate heat. The flow rate of the second refrigerant having radiated heat in the cascade heat exchanger 35 is adjusted in the heat source-side expansion valve 36, and then flows into the second receiver 45. A part of the second refrigerant having flowed out of the second receiver 45 is branched into the second subcooling circuit 48, is decompressed at the second subcooling expansion valve 48*a*, and then joins the suction flow path 23. In the second subcooling heat exchanger 47, a part of the remaining refrigerant having flowed out of the second receiver 45 is cooled by the refrigerant flowing in the subcooling circuit 48, is then sent to the third connection pipe 7 via the fifth shutoff valve 31, and joins the refrigerant having radiated heat in the second heat exchanger 52*c*.

The refrigerant having joined in the third connection pipe 7 is branched into two portions to be sent to each of the third branch pipes 61*a* and 61*b* of the branch units 6*a* and 6*b*. Thereafter, the refrigerant having flowed through the second connecting tubes 16*a* and 16*b* is sent to the second utilization pipes 56*a* and 56*b* of the first and second utilization units 3*a* and 3*b*. The refrigerant flowing in the second utilization pipes 56*a* and 56*b* passes the utilization-side expansion valves 51*a* and 51*b* in the utilization units 3*a* and 3*b*.

Then, the refrigerant having passed the utilization-side expansion valves 51*a* and 51*b* whose opening degrees are adjusted exchanges heat with indoor air supplied by the second fans 53*a* and 53*b* in the second heat exchangers 52*a* and 52*b*. The refrigerant flowing in the second heat exchangers 52*a* and 52*b* is thus evaporated into a low-pressure gas refrigerant. Indoor air is cooled and is supplied into the indoor space. The indoor space is thus cooled. The low-pressure gas refrigerant evaporated in the second heat exchangers 52*a* and 52*b* is sent to the junction pipes 62*a* and 62*b* of the first and second branch units 6*a* and 6*b*.

The low-pressure gas refrigerant sent to the junction pipes 62*a* and 62*b* is sent to the fifth connection pipe 9 via the second control valves 67*a* and 67*b* and the second branch pipes 64*a* and 64*b*, to join.

The low-pressure gas refrigerant sent to the fifth connection pipe 9 is returned to the suction side of the second compressor 21 via the fourth shutoff valve 33, the second heat source pipe 29, the suction flow path 23, and the second accumulator 30.

Note that, in this cooling main operation, the second circuit 10 controls capacity, for example, by controlling the second compressor 21 such that evaporation temperature in a heat exchanger functioning as an evaporator for the second refrigerant among the second heat exchanger 52*a*, 52*b*, and 52*c* becomes predetermined evaporation target temperature. Then, the first circuit 5*a* controls capacity, for example, by controlling the first compressor 71 such that evaporation temperature of the first refrigerant in the first flow path 35*b* of the cascade heat exchanger 35 becomes predetermined evaporation target temperature. Here, the evaporation target temperature is changed such that a carbon dioxide refrigerant flowing through the second flow path 35*a* of the cascade heat exchanger 35 does not exceed a critical point when an operation condition is not a predetermined operation condition in which the carbon dioxide refrigerant exceeds the critical point. Also, the evaporation target temperature is changed such that the carbon dioxide refrigerant exceeds the critical point by more than a predetermined amount when the operation condition is the predetermined operation condition in which the carbon dioxide refrigerant exceeds the critical point.

Behavior during the cooling main operation is executed in this manner.

(8-4) Heating Main Operation

Figure 6:
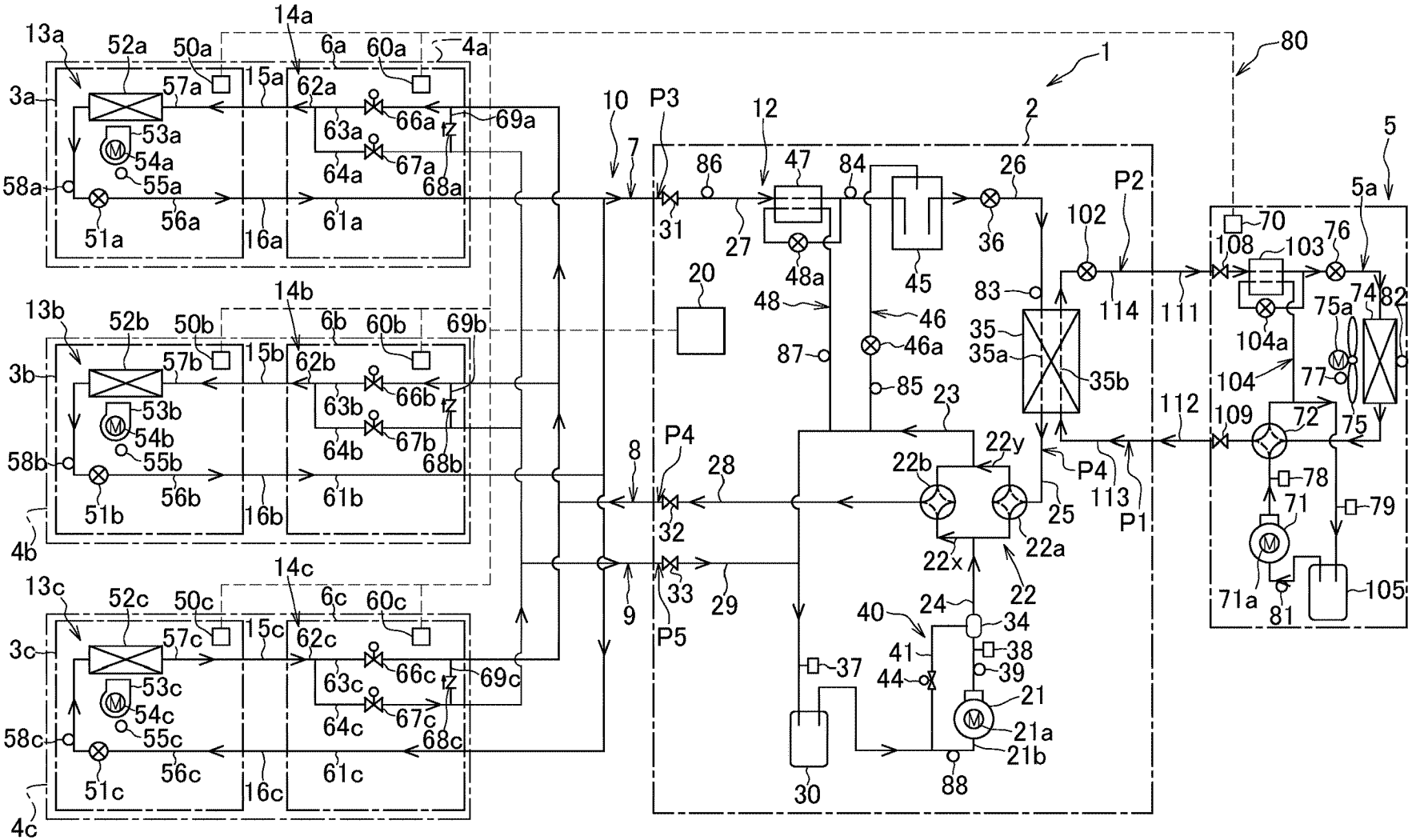
FIG. 6 is a diagram illustrating behavior (flows of the refrigerant) in a simultaneous cooling and heating operation (heating main operation) of the refrigeration system.

In the heating main operation, for example, the second heat exchangers 52*a* and 52*b* in the utilization units 3*a* and 3*b* each function as a refrigerant radiator, and the second heat exchanger 52*c* functions as a refrigerant evaporator. In the heating main operation, the cascade heat exchanger 35 functions as an evaporator for the second refrigerant. In the heating main operation, the first circuit 5*a* and the second circuit 10 of the refrigeration system 1 are configured as shown in FIG. 6. Arrows attached to the first circuit 5*a* and arrows attached to the second circuit 10 in FIG. 6 indicate flows of the refrigerant during the heating main operation.

Specifically, in the first unit 5, the first switching mechanism 72 is switched to a sixth operating state to cause the cascade heat exchanger 35 to function as a radiator for the first refrigerant. The sixth operating state of the first switching mechanism 72 corresponds to a connecting state depicted by broken lines in the first switching mechanism 72 in FIG. 6. Accordingly, in the first unit 5, the first refrigerant having discharged from the first compressor 71 and passed through the first switching mechanism 72 and the first shutoff valve 109 passes through the first connection pipe 112, and is sent to the first flow path 35*b* of the cascade heat exchanger 35. The refrigerant flowing in the first flow path 35*b* of the cascade heat exchanger 35 exchanges heat with the second refrigerant flowing in the second flow path 35*a* to be condensed. The first refrigerant condensed in the cascade heat exchanger 35 passes through the second expansion valve 102 controlled into the fully opened state, thereafter, flows through the second connection pipe 111, the second shutoff valve 108, and the first subcooling heat exchanger 103 in that order, and is decompressed by the first expansion valve 76. During the heating main operation, the first subcooling expansion valve 104*a* is controlled into the closed state, so that the refrigerant does not flow into the first subcooling circuit 104. Therefore, no heat is exchanged in the first subcooling heat exchanger 103. The valve opening degree of the first expansion valve 76 is controlled such that, for example, a degree of superheating of the refrigerant sucked into the first compressor 71 satisfies a predetermined condition. The refrigerant decompressed at the first expansion valve 76 exchanges heat with outdoor air supplied from the first fan 75 in the first heat exchanger 74 to be evaporated, and is sucked into the first compressor 71 via the first switching mechanism 72 and the first accumulator 105.

In the cascade unit 2, the second switching mechanism 22 is switched to the second connecting state. In the second connecting state of the second switching mechanism 22, the discharge flow path 24 and the first heat source pipe 28 are connected by the second switching valve 22*b*, and the third heat source pipe 25 and the suction flow path 23 are connected by the first switching valve 22*a*. The cascade heat exchanger 35 thus functions as an evaporator for the second refrigerant. The opening degree of the heat source-side expansion valve 36 is adjusted. In the first to third branch units 6*a*, 6*b*, and 6*c*, the first control valves 66*a* and 66*b* and the second control valve 67*c* are controlled into the opened state, and the first control valve 66*c* and the second control valves 67*a* and 67*b* are controlled into the closed state. Accordingly, the second heat exchangers 52*a* and 52*b* in the utilization units 3*a* and 3*b* each function as a refrigerant radiator, and the second heat exchanger 52*c* in the utilization unit 3*c* functions as a refrigerant evaporator. Then, the second heat exchanger 52*c* in the utilization unit 3*c* and the suction side of the second compressor 21 in the cascade unit 2 are connected via the first utilization pipe 57*c*, the first connecting tube 15*c*, the junction pipe 62*c*, the second branch pipe 64*c*, and the fifth connection pipe 9. The second heat exchangers 52*a* and 52*b* in the utilization units 3*a* and 3*b* and the discharge side of the second compressor 21 in the cascade unit 2 are connected via the discharge flow path 24, the first heat source pipe 28, the fourth connection pipe 8, the first branch pipes 63*a* and 63*b*, the junction pipes 62*a* and 62*b*, the first connecting tubes 15*a* and 15*b*, and the first utilization pipes 57*a* and 57*b*. The second subcooling expansion valve 48*a* and the bypass expansion valve 46*a* are controlled into the closed state. In the utilization units 3*a*, 3*b*, and 3*c*, the opening degrees of the utilization-side expansion valves 51*a*, 51*b*, and 51*c* are adjusted.

In such a second circuit 10, the high-pressure refrigerant compressed and discharged by the second compressor 21 is sent to the fourth connection pipe 8 through the second switching valve 22*b* of the second switching mechanism 22, the first heat source pipe 28, and the third shutoff valve 32.

The high-pressure refrigerant sent to the fourth connection pipe 8 is branched into two portions to be sent to the first branch pipes 63*a* and 63*b* of the first branch unit 6*a* and the second branch unit 6*b* respectively connected to the first utilization unit 3*a* and the second utilization unit 3*b* in operation. The high-pressure refrigerant sent to the first branch pipes 63*a* and 63*b* is sent to the second heat exchangers 52*a* and 52*b* in the first utilization unit 3*a* and the second utilization unit 3*b* via the first control valves 66*a* and 66*b*, the junction pipes 62*a* and 62*b*, and the first connecting tubes 15*a* and 15*b*.

Then, the high-pressure second refrigerant sent to the second heat exchangers 52*a* and 52*b* exchanges heat with indoor air supplied by the second fans 53*a* and 53*b* in the second heat exchangers 52*a* and 52*b*. The refrigerant flowing in the second heat exchangers 52*a* and 52*b* thus radiates heat. Indoor air is heated and is supplied into the indoor space. The indoor space is thus heated. The refrigerant having radiated heat in the second heat exchangers 52*a* and 52*b* flows in the second utilization pipes 56*a* and 56*b*, and passes the utilization-side expansion valves 51*a* and 51*b* whose opening degrees are adjusted. Thereafter, the refrigerant having flowed through the second connecting tubes 16*a* and 16*b* is sent to the third connection pipe 7 via the third branch pipes 61*a* and 61*b* of the branch units 6*a* and 6*b*.

Part of the refrigerant sent to the third connection pipe 7 is sent to the third branch pipe 61*c* of the branch unit 6*c*, and the remaining refrigerant is sent to the heat source-side expansion valve 36 via the fifth shutoff valve 31.

Then, the refrigerant sent to the third branch pipe 61*c* flows in the second utilization pipe 56*c* of the utilization unit 3*c* via the second connecting tube 16*c*, and is sent to the utilization-side expansion valve 51*c*.

Then, the refrigerant having passed the utilization-side expansion valve 51*c* whose opening degree is adjusted exchanges heat with indoor air supplied by the second fan 53*c* in the second heat exchanger 52*c*. The refrigerant flowing in the second heat exchanger 52*c* is thus evaporated into a low-pressure gas refrigerant. Indoor air is cooled and is supplied into the indoor space. The indoor space is thus cooled. The low-pressure gas refrigerant evaporated in the second heat exchanger 52*c* passes through the first utilization pipe 57*c* and the first connecting tube 15*c* to be sent to the junction pipe 62*c*.

The low-pressure gas refrigerant sent to the junction pipe 62*c* is sent to the fifth connection pipe 9 via the second control valve 67*c* and the second branch pipe 64*c*.

The low-pressure gas refrigerant sent to the fifth connection pipe 9 is returned to the suction side of the second compressor 21 via the fourth shutoff valve 33, the second heat source pipe 29, the suction flow path 23, and the second accumulator 30.

The second refrigerant sent to the heat source-side expansion valve 36 passes through the heat source-side expansion valve 36 controlled in opening degree, and then exchanges heat with the first refrigerant flowing in the first flow path 35*b* in the second flow path 35*a* of the cascade heat exchanger 35. As a result, the refrigerant flowing in the second flow path 35*a* of the cascade heat exchanger 35 is evaporated into a low-pressure gas refrigerant, and is sent to the first switching valve 22*a* of the second switching mechanism 22. The low-pressure gas refrigerant sent to the first switching valve 22*a* of the second switching mechanism 22 joins the low-pressure gas refrigerant evaporated in the second heat exchanger 52*c* in the suction flow path 23. The refrigerant thus joined is returned to the suction side of the second compressor 21 via the second accumulator 30.

In this heating main operation, the second circuit 10 controls capacity, for example, by controlling the second compressor 21 so as to process a load in a heat exchanger functioning as a radiator for the second refrigerant among the second heat exchangers 52*a*, 52*b*, and 52*c*. Then, the first circuit 5*a* controls capacity, for example, by controlling the first compressor 71 such that condensation temperature of the first refrigerant in the first flow path 35*b* of the cascade heat exchanger 35 becomes predetermined condensation target temperature.

Behavior during the heating main operation is executed in this manner.

(9) Characteristics (9-1)

The cascade unit 2 according to the present embodiment is the cascade unit 2 of the refrigeration system 1 including the first circuit 5*a*, the second circuit 10, and the cascade heat exchanger 35. A heat medium that conveys heat flows through the first circuit 5*a*. The first circuit 5*a* includes a first heat exchanger 74. The first heat exchanger 74 causes heat exchange between a heat source and the heat medium. The second circuit 10 includes the second compressor 21 and the second heat exchangers 52*a*, 52*b*, and 52*c*. The second compressor 21 compresses the second refrigerant. The second heat exchanger 52*a*, 52*b*, and 52*c* exchanges heat between the second refrigerant and indoor air. The second refrigerant circulates through the second circuit 10. The cascade heat exchanger 35 exchanges heat between the heat medium in the first circuit 5*a* and the second refrigerant in the second circuit 10. The cascade unit 2 includes the cascade heat exchanger 35, the second compressor 21, and the cascade casing 2*x*. The cascade casing 2*x* accommodates the cascade heat exchanger 35 and the second compressor 21. The first circuit 5*a* includes the first connecting portion C1. The first connecting portion C1 connects the first pipe P1 and the second pipe P2 extending from the cascade heat exchanger 35, of the first pipe P1 and the second pipe P2 connecting the first heat exchanger 74 and the cascade heat exchanger 35, to the first pipe P1 and the second pipe P2 extending from the first heat exchanger 74 inside or outside the cascade casing 2*x*. The second circuit 10 includes the second connecting portion C2. The second connecting portion C2 connects the liquid pipe P3 and the gas pipes P4 and P5 extending from the cascade heat exchanger 35, among the liquid pipe P3 and the gas pipes P4 and P5 connecting the second heat exchangers 52*a*, 52*b*, and 52*c* and the cascade heat exchanger 35, to the liquid pipe P3 and the gas pipes P4 and P5 extending from the second heat exchangers 52*a*, 52*b*, and 52*c* inside or outside the cascade casing 2*x*. The first connecting portion C1 and the second connecting portion C2 are disposed close to each other.

In the cascade unit 2 according to the present embodiment, the first connecting portion C1 of the first pipe P1 and the second pipe P2 in the first circuit 5*a* and the second connecting portion C2 of the liquid pipe P3 and the gas pipes P4 and P5 in the second circuit 10 are disposed close to each other. Therefore, the first pipe P1, the second pipe P2, the liquid pipe P3, and the gas pipes P4 and P5 can be collected at predetermined positions of the cascade casing 2*x*. As a result, the first pipe P1 and the second pipe P2 extend from predetermined positions to the first unit 5 outside having the first heat exchanger 74, and the liquid pipe P3 and the gas pipes P4 and P5 extend from predetermined positions to the second units 4*a*, 4*b*, and 4*c* outside having the second heat exchangers 52*a*, 52*b*, and 52*c*. Accordingly, a degree of freedom in installation of the cascade unit 2 can be increased.

(9-2)

In the cascade unit 2 according to the present embodiment, the common pipe opening O1 is preferably formed in the cascade casing 2*x*. The first pipe P1, the second pipe P2, the liquid pipe P3, and the gas pipes P4 and P5 are located in the pipe opening O1.

Here, the first pipe P1, the second pipe P2, the liquid pipe P3, and the gas pipes P4 and P5 are collected in the pipe opening O1 of the cascade casing 2*x*. Therefore, the first pipe P1 and the second pipe P2 extend from the pipe opening O1 toward the first unit 5, and the liquid pipe P3 and the gas pipes P4 and P5 extend from the pipe opening O1 toward the second units 4*a*, 4*b*, and 4*c*. Therefore, the degree of freedom in installation of the cascade unit 2 can be easily increased.

(9-3)

In the cascade unit 2 according to the present embodiment, the cascade casing 2*x* preferably has the front surface 120*a* as a side surface. The front surface 120*a* as a side surface extends in the first direction (up-down direction in FIG. 8) extending up and down and the second direction (left-right direction in FIG. 8) intersecting the first direction. The first connecting portion C1 and the second connecting portion C2 are located on one side (the left side in FIG. 8) with respect to the center of the front surface 120*a* in the second direction when viewed from the front surface 120*a*.

Here, when viewed from the front surface 120*a*, the first pipe P1, the second pipe P2, the liquid pipe P3, and the gas pipes P4 and P5 are collected on one side (the left side in FIG. 8) of the center in the second direction (the left-right direction in FIG. 2). Accordingly, the degree of freedom in installation of the cascade unit 2 can be further increased.

(9-4)

In the cascade unit 2 according to the present embodiment, the heating medium preferably includes the first refrigerant. The first refrigerant includes at least one of an HFC refrigerant or an HFO refrigerant. The second refrigerant includes carbon dioxide. The distance L2 between the second connecting portion C2 (C21) of the liquid pipe P3 and the second connecting portions C2 (C22 and C23) of the gas pipes P4 and P5 is larger than the distance L1 between the first connecting portion C1 (C11) of the first pipe P1 and the first connecting portion C1 (C12) of the second pipe P2.

Here, the first refrigerant including at least one of the HFC refrigerant or the HFO refrigerant flows in the first circuit 5*a*, and the carbon dioxide refrigerant flows in the second circuit 10 as the second refrigerant. A pressure resistance of a pipe that encloses the carbon dioxide refrigerant is higher than a pressure resistance of a pipe that encloses the HFC refrigerant and the HFO refrigerant. Therefore, the pipe enclosing the carbon dioxide refrigerant is more rigid than the pipe enclosing the HFC refrigerant and the HFO refrigerant, and thus, is difficult to bend. Here, the distance L2 between the liquid pipe P3 enclosing the carbon dioxide refrigerant and the gas pipes P4 and P5 is larger than the distance L1 between the first pipe P1 enclosing the first refrigerant including at least one of the HFC refrigerant or the HFO refrigerant and the second pipe P2. It is therefore possible to provide, between the liquid pipe P3 and the gas pipes P4 and P5, a gap into which a tool for attaching the joint members J1, J2, and J3 and the like can enter, instead of performing bending. As described above, a tool can be used at the time of installing the liquid pipe P3 and the gas pipes P4 and P5 which enclose the carbon dioxide refrigerant.

(9-5)

In the cascade unit 2 according to the present embodiment, the second connecting portion C2 is preferably the third shutoff valve 32, the fourth shutoff valve 33, and the fifth shutoff valve 31. The third shutoff valve 32, the fourth shutoff valve 33, and the fifth shutoff valve 31 are accommodated in the cascade casing 2*x*. The liquid pipe P3 and the gas pipes P4 and P5 extending from the second heat exchangers 52*a*, 52*b*, and 52*c* are respectively connected to the third shutoff valve 32, the fourth shutoff valve 33, and the fifth shutoff valve 31 via the joint members J1, J2, and J3.

As described above, the liquid pipe P3 and the gas pipes P4 and P5 of the second circuit 10 which enclose carbon dioxide are too rigid to bend. Here, the joint members J1, J2, and J3 are used instead of bending the liquid pipe P3 and the gas pipes P4 and P5 of the second circuit 10. Therefore, the liquid pipe P3 and the gas pipes P4 and P5 of the second circuit 10 can be led out of the third shutoff valve 32, the fourth shutoff valve 33, and the fifth shutoff valve 31 to outside of the cascade casing 2*x* by using the joint members J1, J2, and J3.

(9-6)

The cascade unit 2 according to the present embodiment preferably further includes a fixing member that fixes the first connecting portion C1 to the cascade casing 2*x*.

Here, the first connecting portion C1 is fixed to the cascade casing 2*x* by the fixing member. It is therefore possible to suppress vibration of pipes of the first pipe P1 and the second pipe P2 near the first connecting portion C1, the pipes being left without further treatment after being cut. Therefore, the cascade unit 2 can be stably transported.

(9-7)

In the cascade unit 2 according to the present embodiment, the cascade casing 2*x* preferably has a bottom plate constituting the bottom surface 120*f*. The first pipe P1 and the second pipe P2, the liquid pipe P3, and the gas pipes P4 and P5 are disposed at positions higher than the bottom plate by 17 mm or more.

Here, an interval between the bottom plate and the first pipe P1, the second pipe P2, the liquid pipe P3, and the gas pipes P4 and P5 is 17 mm or more. Therefore, even if the drain pan is formed on the bottom plate, interference with the drain pan can be suppressed.

(9-8)

In the cascade unit 2 according to the present embodiment, the cascade casing 2*x* preferably has a side surface (for example, the front surface 120*a*) extending in the up-down direction. The first connecting portion C1 and the second connecting portion C2 are located below the center in the up-down direction.

Here, the first pipe P1, the second pipe P2, the liquid pipe P3, and the gas pipes P4 and P5 are collected in a lower part of near the cascade casing 2*x*. Accordingly, the degree of freedom in installation of the cascade unit 2 can be further increased.

(9-9)

The refrigeration system 1 according to the present embodiment includes the first unit 5 and the second units 4*a*, 4*b*, and 4*c*. The first unit 5 includes the first heat exchanger 74. The second units 4*a*, 4*b*, and 4*c* include the second heat exchangers 52*a*, 52*b*, and 52*c*. The first unit 5 is disposed to a side of the cascade unit 2.

Here, the first pipe P1 and the second pipe P2 are collected at predetermined positions of the cascade casing 2*x* of the cascade unit 2. Therefore, the first pipe P1 and the second pipe P2 can be easily extended from the cascade unit 2 toward the first unit 5 disposed to a side of the cascade unit 2.

(9-10)

In the refrigeration system 1 according to the present embodiment, the cascade unit 2 and the first unit 5 are preferably disposed on a rooftop of the building.

Here, since the first unit 5 and the cascade unit 2 are disposed on the rooftop of the building, even if the first refrigerant which is enclosed in the first circuit 5*a* leaks, the first refrigerant can be prevented from flowing into the indoor space. Therefore, a flammable refrigerant can be used as the first refrigerant.

(10) Modifications (10-1) Modification 1

Figure 13:
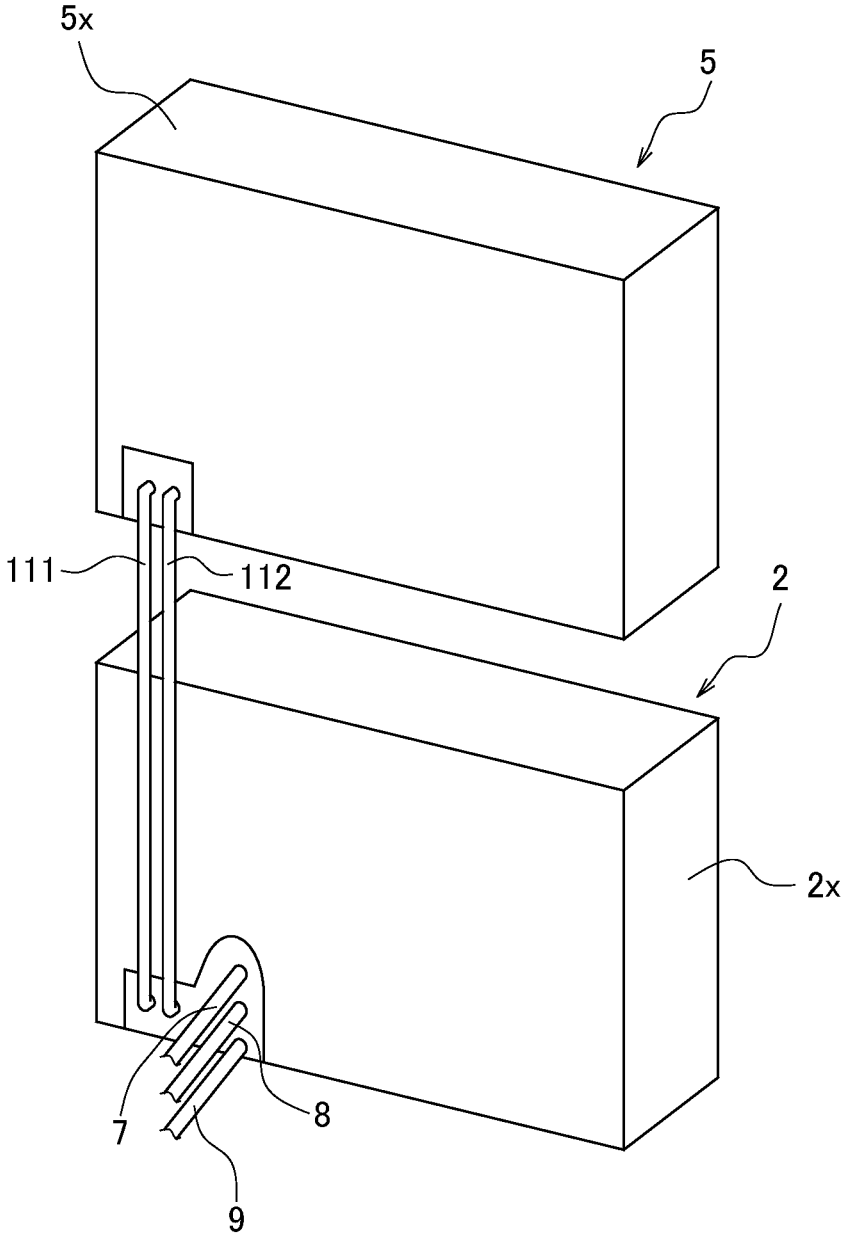
FIG. 13 is a schematic diagram illustrating connection between a first unit and a cascade unit in a modification.

In the above embodiment, the first unit 5 is disposed to a side of the cascade unit 2, but the present disclosure is not limited to this arrangement. In the present modification, the first unit 5 is disposed above the cascade unit 2 as shown in FIG. 13.

Although the first unit 5 may be disposed on the cascade unit 2, a mounting table on which the first unit is disposed is provided on the cascade unit 2 in the present modification.

In the present modification, the connection pipes 111 and 112 connecting the cascade unit 2 and the first unit 5 are led out upward from the pipe opening O1 of the cascade casing 2*x*. The connection pipes 7, 8, and 9 connecting the cascade unit 2 and the second units 4*a*, 4*b*, and 4*c* are also led out of the pipe opening O1 along the horizontal direction.

In the present modification, the first unit 5 is disposed above the cascade unit 2. In the present modification, since the first pipe P1 and the second pipe P2 are collected at predetermined positions of the cascade casing 2*x*, the first pipe P1 and the second pipe P2 can be easily extended from the cascade unit 2 toward the first unit 5 disposed above.

(10-2) Modification 2

In the above embodiment, the second circuit 10 has the three second connecting portions C21, C22, and C23, but in the present modification, the second circuit 10 has two connecting portions. In this case, in the second circuit, the number of gas pipes connecting the second heat exchanger and the cascade heat exchanger is one. The present modification is applied to, for example, a configuration in which the plurality of utilization units 3*a*, 3*b*, and 3*c* cannot individually perform the cooling operation or the heating operation, and a configuration in which there is one second unit.

(10-3) Modification 3

In the above embodiment, the first pipe P1, the second pipe P2, the liquid pipe P3, and the gas pipes P4 and P5 are led out of one pipe opening O1 of the cascade casing 2*x*, but the present disclosure is not limited to this configuration. In the present modification, the first pipe P1, the second pipe P2, the liquid pipe P3, and the gas pipes P4 and P5 are led out of the plurality of pipe openings.

In this case, the plurality of pipe openings is disposed close to each other. Specifically, when viewed from the front surface 120*a*, the plurality of pipe openings is formed in a range from one end in the second direction (in FIG. 8, the left end in the left-right direction) to one third of the width in the second direction. The plurality of pipe openings may be formed on a plurality of surfaces of the bottom surface 120*f*, the upper surface 120*e*, the left surface 120*c*, and the right surface 120*d* except for the rear surface 120*b*.

(10-4) Modification 4

In the above embodiment, the pipe opening O1 is formed in the front surface 120*a* of the cascade casing 2*x*, but the present disclosure is not limited to this configuration. The pipe opening O1 may be formed on any surface of the cascade casing 2*x*, but is preferably formed on at least one of the front surface 120*a*, the bottom surface 120*f*, the upper surface 120*e*, the left surface 120*c* plate, or the right surface 120*d* except for the rear surface 120*b*.

(10-5) Modification 5

In the above embodiment, the pipe opening O1 and the wire opening O2 are formed on one surface of the cascade casing 2*x*, but the present disclosure is not limited to this configuration. The pipe opening O1 and the wire opening O2 may be formed on different surfaces.

(10-6) Modification 6

In the above embodiment, R32 or R410A is exemplified as the refrigerant used in the first circuit 5*a*, and carbon dioxide is exemplified as the refrigerant used in the second circuit 10, but the present disclosure is not limited to these examples.

As the refrigerant used in the first circuit 5*a*, R32, an HFO refrigerant, a mixed refrigerant of R32 and an HFO refrigerant, carbon dioxide, ammonia, propane, or the like can be used.

As the refrigerant used in the second circuit 10, R32, an HFO refrigerant, a mixed refrigerant of R32 and an HFO refrigerant, carbon dioxide, ammonia, propane, or the like can be used.

Examples of the HFO refrigerant include HFO-1234yf and HFO-1234ze.

The same refrigerant or different refrigerants may be used in the first circuit 5*a* and the second circuit 10. Preferably, the refrigerant used in the second circuit 10 has at least one of lower global warming potential (GWP), lower ozone depletion potential (ODP), lower flammability, or lower toxicity than the refrigerant used in the first circuit 5*a*. In particular, when an overall content volume of the second circuit 10 is larger than an overall content volume of the first circuit 5*a*, by using the refrigerant lower than the refrigerant in the first circuit 5*a* in at least one of the global warming potential (GWP), the ozone depletion potential (ODP), the flammability, or the toxicity in the second circuit 10, adverse effects when a leak occurs can be reduced.

(10-7) Modification 7

In the above embodiment, an example has been described in which the first refrigerant as the heat medium circulates in the first circuit 5*a*, but the present disclosure is not limited to this example. In the first circuit 5*a*, a medium other than the refrigerant may be used as the heat medium. In the present modification, instead of the first circuit 5*a* through which the first refrigerant flows, a heat medium circuit through which a heat medium such as water or brine flows is used. In this case, the heat medium circuit may include a heat source that functions as a heating source or a cooling source, and a pump for circulating the heat medium. In this case, the flow rate can be adjusted by the pump, and the amount of heat can be controlled by the heating source or the cooling source.

(10-8) Modification 8

In the above embodiment, as the first unit 5, an outdoor unit including the first fan 75 for supplying the first heat exchanger 74 with outdoor air that exchanges heat with the first refrigerant has been described as an example, but the present disclosure is not limited to this example. As described above, the heat source of the present disclosure is not limited to outdoor air that exchanges heat with the first refrigerant. In the present modification, the first unit does not include the first fan 75, and causes the first heat exchanger 74 to exchange heat between the first refrigerant and water as a heat source.

(10-9) Modification 9

In the above embodiment, the refrigeration system 1 in which one cascade unit 2 is connected to one first unit 5 has been described as an example, but the present disclosure is not limited to this example. In the refrigeration system 1 of the present modification, a plurality of cascade units 2 is connected in parallel to one first unit 5.

(10-10) Modification 10

In the above embodiment, the refrigeration system 1 in which a plurality of second units 4*a*, 4*b*, and 4*c* is connected to one cascade unit 2 has been described as an example, but the present disclosure is not limited to this example. In the refrigeration system 1 of the present modification, one second unit is connected to one cascade unit 2.

Although the embodiments of the present disclosure have been described above, it will be understood that various changes in form and details can be made without departing from the gist and scope of the present disclosure described in the claims.

REFERENCE SIGNS LIST

1: refrigeration system
2: Cascade unit
2*x*: cascade casing (casing)
4*a*, 4*b*, 4*c*: second unit
5: first unit
5*a*: first circuit
10: second circuit
21: second compressor (compressor)
31: first shutoff valve
32: second shutoff valve
35: cascade heat exchanger
52*a*, 52*b*, 52*c*: second heat exchanger
74: first heat exchanger
120*a*: side surface
120*f*: bottom surface
C1, C11, C12: first connecting portion
C2, C21, C22, C23: second connecting portion
J1, J1, J3: joint member
L1, L2: distance
O1: pipe opening (opening)
O2: wire opening
P1: first pipe
P2: second pipe
P3: liquid pipe
P4, P5: gas pipe

CITATION LIST

Patent Literature

Patent literature 1: JP 2012-193866 A

The invention claimed is:

1. A cascade unit of a refrigeration system including a first circuit through which a heat medium carrying heat flows, including a first heat exchanger that exchanges heat between a heat source and the heat medium, a second circuit including a compressor that compresses a refrigerant and a second heat exchanger that exchanges heat between the refrigerant and indoor air, the refrigerant circulating the second circuit, a cascade heat exchanger that exchanges heat between the heat medium in the first circuit and the refrigerant in the second circuit, the cascade unit comprising:

the cascaded heat exchanger;

the compressor; and a casing that accommodates the cascade heat exchanger and the compressor, wherein the first circuit includes a first connecting portion that connects a first pipe and a second pipe extending from the cascade heat exchanger, the first pipe and the second pipe connecting the first heat exchanger and the cascade heat exchanger, to the first pipe and the second pipe extending from the first heat exchanger inside or outside the casing, the second circuit includes a second connecting portion that connects a liquid pipe and a gas pipe extending from the cascade heat exchanger, the liquid pipe and the gas pipe connecting the second heat exchanger and the cascade heat exchanger, the liquid pipe and the gas pipe extending from the second heat exchanger inside or outside the casing, the first connecting portion and the second connecting portion are disposed close to each other, the casing has a side surface that extends in a first direction extending up and down and a second direction intersecting the first direction, and the first connecting portion and the second connecting portion are located on one side with respect to a center of the side surface in the second direction when viewed from the side surface.

2. A cascade unit of a refrigeration system including a first circuit through which a heat medium carrying heat flows, including a first heat exchanger that exchanges heat between a heat source and the heat medium, the heat medium including a first refrigerant, a second circuit including a compressor that compresses a second refrigerant and a second heat exchanger that exchanges heat between the second refrigerant and indoor air, the second refrigerant circulating the second circuit, a cascade heat exchanger that exchange heat between the heat medium in the first circuit and the second refrigerant in the second circuit, the cascade unit comprising:

the cascaded heat exchanger;

the compressor; and a casing that accommodates the cascade heat exchanger and the compressor, wherein the first circuit includes a first connecting portion that connects a first pipe and a second pipe extending from the cascade heat exchanger, the first pipe and the second pipe connecting the first heat exchanger and the cascade heat exchanger, the first pipe and the second pipe extending from the first heat exchanger inside or outside the casing, the second circuit includes a second connecting portion that connects a liquid pipe and a gas pipe extending from the cascade heat exchanger, the liquid pipe and the gas pipe connecting the second heat exchanger and the cascade heat exchanger, the liquid pipe and the gas pipe extending from the second heat exchanger inside or outside the casing, the first connecting portion and the second connecting portion are disposed close to each other, the first refrigerant includes at least one of an HFC refrigerant or an HFO refrigerant, the second refrigerant includes carbon dioxide, and a distance between the second connecting portion of the liquid pipe and the second connecting portion of the gas pipe is larger than a distance between the first connecting portion of the first pipe and the first connecting portion of the second pipe.

3. The cascade unit according to claim 2, wherein the second connecting portion includes a first shutoff valve and a second shutoff valve accommodated in the casing, and the liquid pipe and the gas pipe extending from the second heat exchanger are respectively connected to the first shutoff valve and the second shutoff valve via a joint member.

4. The cascade unit according to claim 1, wherein the casing is provided with a common opening in which the first pipe, the second pipe, the liquid pipe, and the gas pipe are located.

5. The cascade unit according to claim 1, further comprising a fixing member that fixes the first connecting portion to the casing.

6. The cascade unit according to claim 1, wherein the casing has a bottom plate constituting a bottom surface, and the first pipe, the second pipe, the liquid pipe, and the gas pipe are disposed at positions higher than the bottom plate by 17 mm or more.

7. The cascade unit according to claim 1, wherein the first connecting portion and the second connecting portion are located below a center in the up-down direction.

8. A refrigeration system comprising:

the cascade unit according to claim 1;

a first unit including the first heat exchanger; and a second unit including the second heat exchanger, wherein the first unit is disposed to a side of the cascade unit or disposed above the cascade unit.

9. The refrigeration system according to claim 8, wherein the cascade unit and the first unit are disposed on a rooftop of a building.

10. The cascade unit according to claim 2, wherein the casing is provided with a common opening in which the first pipe, the second pipe, the liquid pipe, and the gas pipe are located.

11. The cascade unit according to claim 3, wherein the casing is provided with a common opening in which the first pipe, the second pipe, the liquid pipe, and the gas pipe are located.

12. The cascade unit according to claim 2, further comprising a fixing member that fixes the first connecting portion to the casing.

13. The cascade unit according to claim 3, further comprising a fixing member that fixes the first connecting portion to the casing.

14. The cascade unit according to claim 4, further comprising a fixing member that fixes the first connecting portion to the casing.

15. The cascade unit according to claim 2, wherein the casing has a bottom plate constituting a bottom surface, and the first pipe, the second pipe, the liquid pipe, and the gas pipe are disposed at positions higher than the bottom plate by 17 mm or more.

16. The cascade unit according to claim 3, wherein the casing has a bottom plate constituting a bottom surface, and the first pipe, the second pipe, the liquid pipe, and the gas pipe are disposed at positions higher than the bottom plate by 17 mm or more.

17. The cascade unit according to claim 4, wherein the casing has a bottom plate constituting a bottom surface, and the first pipe, the second pipe, the liquid pipe, and the gas pipe are disposed at positions higher than the bottom plate by 17 mm or more.

18. The cascade unit according to claim 5, wherein the casing has a bottom plate constituting a bottom surface, and the first pipe, the second pipe, the liquid pipe, and the gas pipe are disposed at positions higher than the bottom plate by 17 mm or more.

19. The cascade unit according to claim 2, wherein the casing has a side surface extending in an up-down direction, and the first connecting portion and the second connecting portion are located below a center in the up-down direction.

20. The cascade unit according to claim 3, wherein the casing has a side surface extending in an up-down direction, and the first connecting portion and the second connecting portion are located below a center in the up-down direction.

* * * * *